US006487858B2

(12) United States Patent
Cammack

(10) Patent No.: US 6,487,858 B2
(45) Date of Patent: Dec. 3, 2002

(54) METHOD AND APPARATUS FOR DIMINISHING THE CONSUMPTION OF FUEL AND CONVERTING RECIPROCAL PISTON MOTION INTO ROTARY MOTION

(76) Inventor: Charles H. Cammack, 7911 Darnell, Lenexa, KS (US) 66215

( * ) Notice: Subject to any disclaimer, the term of this patent is extended or adjusted under 35 U.S.C. 154(b) by 0 days.

(21) Appl. No.: 09/963,769

(22) Filed: Sep. 26, 2001

(65) Prior Publication Data

US 2002/0035834 A1 Mar. 28, 2002

Related U.S. Application Data

(60) Provisional application No. 60/235,699, filed on Sep. 27, 2000.

(51) Int. Cl.[7] ..... F01B 29/10

(52) U.S. Cl. ..... 60/517; 60/525; 92/31; 92/129; 417/222.1

(58) Field of Search ..... 92/31, 129, 138, 92/140; 417/221.1, 227.1, 222.2, 269; 60/517, 525

(56) References Cited

U.S. PATENT DOCUMENTS

| | | | | |
|---|---|---|---|---|
| 4,439,985 A | * | 4/1984 | Lamb | 60/518 |
| 4,858,480 A | | 8/1989 | Rhode et al. | |
| 4,991,492 A | | 2/1991 | Bratt et al. | |
| 4,996,841 A | | 3/1991 | Meijer et al. | |
| 5,103,643 A | * | 4/1992 | Ross | 60/517 |
| 5,345,765 A | * | 9/1994 | Kinnersly | 60/525 |
| 5,394,700 A | * | 3/1995 | Steele | 60/525 |
| 5,505,047 A | * | 4/1996 | Hirose et al. | 60/520 X |
| 5,533,335 A | * | 7/1996 | Shin | 60/517 |

* cited by examiner

*Primary Examiner*—Hoang Nguyen
(74) *Attorney, Agent, or Firm*—Hovey Williams LLP

(57) ABSTRACT

An apparatus for converting between reciprocal piston motion and rotary shaft motion. A unique H-shaped piston rod configuration and corresponding cylinder assembly for improving the efficiency of internal and external combustion engines. A Stirling engine having improved efficiency due to the use of heat exchangers that are integral with the cylinder assemblies. A Stirling engine employing a novel apparatus for rapidly varying power output.

34 Claims, 19 Drawing Sheets

METHOD AND APPARATUS FOR DIMINISHING THE CONSUMPTION OF FUEL AND CONVERTING RECIPROCAL PISTON MOTION INTO ROTARY MOTION

RELATED APPLICATION

This application claims the priority benefit of provisional application Ser. No. 60/235,699, filed Sep. 27, 2000, incorporated into the present application by reference.

BACKGROUND OF THE INVENTION

1. Field of the Invention

The present invention relates generally to systems for converting between reciprocal and rotary motion. In another aspect, the invention concerns barrel-type engines having an elongated drive shaft that is rotated by a plurality of pistons symmetrically spaced around the shaft and reciprocating generally parallel to the axis of rotation of the shaft. In still another aspect, the invention concerns engines employing a non-hydrocarbon-based fluid as a piston lubricant. In a further aspect, the invention relates to parallel, double-acting Stirling engines employing an expandable and contractible working fluid to drive double-ended pistons. In a still further aspect, the invention concerns Stirling engines which employ heat exchangers that are integral with the cylinder assemblies that house the pistons. In a yet further aspect, the invention concerns systems for varying the power output of Stirling engines.

2. Discussion of Prior Art

Many conventional mechanical devices require reciprocal motion to be converted to rotary motion (e.g., engines) or rotary motion to be converted to reciprocal motion (e.g., pumps). An often-employed system for converting between rotary and reciprocal motion involves the use of a crank arm having a first end coupled to a linearly reciprocating piston and a second end coupled to a rotating crank shaft at a location eccentric to the axis of rotation of the crank shaft. Such an arrangement can be inefficient and can produce excessive vibration and noise. Further, such a system can impart a bending moment on the rotating crank shaft, thereby requiring a larger crank shaft in order to minimize the risk of failure due to fatigue.

As an alternative to systems using crank arms to convert between rotary and reciprocal motion, several crankless systems have been developed. These crankless systems typically employ a swash plate/roller arrangement. In such a arrangement the swash plate is coupled to a drive shaft for rotation therewith and the roller contacts at least one curved cam surface of the swash plate. The roller is coupled to a linearly reciprocating piston so that when the swash plate is rotated, the roller rolls on the curved cam surface, thereby causing the piston to move linearly. Alternatively, when the piston reciprocates linearly, the roller presses on the curve cam surface, thereby causing the swash plate and the drive shaft to rotate. Such prior art swash plate/roller systems, however, typically cause bending stresses on the drive shaft. Further, such systems have typically produced excessive noise and vibration due to their lack of dynamic balance.

Stirling engines (i.e., external combustion engines) have existed for years but have not been widely commercially implemented. Stirling engines typically operate by heating and cooling an expandable and contractible working fluid in a working fluid chamber to thereby drive reciprocating pistons. A potentially very efficient Stirling engine is known as a "parallel" form of the Franchot engine, described and illustrated in *Principles and Applications of Stirling Engines,* by C. D. West, 1986, pp 64–65, the disclosure of which is incorporated herein by reference. In such a "parallel" Stirling engine, an expansion (i.e., hot) cylinder and a compression (i.e., cold) cylinder, both containing respective double-ended pistons, cooperate with the compressible working fluid to drive the double-ended pistons. One significant advantage of the parallel Stirling arrangement is that the entire expansion cylinder (including both ends of the cylinder) is heated while the entire compression cylinder is cooled. This results in the virtual elimination of thermal shuttle losses typically experienced in serially connected Stirling engines comprising individual cylinders which each have a hot end and a cold end. However, a significant disadvantage of prior art parallel Stirling engines is the difficultly in maintaining a proper working fluid seal when a reciprocating piston rod coupled to the piston extends through an end portion of the cylinder wall that defines the working fluid chamber.

Stirling engines typically employ non-lubricated teflon piston rings to prevent the escape of the working fluid from the working fluid chambers. The main reason teflon rings are used rather than more conventional metallic piston rings is that metallic rings require conventional hydrocarbon-based lubricants to ensure efficient extended operation of the engine. However, using a conventional hydrocarbon-based lubricant in conjunction with a metallic piston ring will inevitably result in some lubricant passing from the lubricant holding chamber on one side of the piston into the working fluid chamber on the other side of the piston. The presence of even trace amounts of conventional hydrocarbon-based engine lubricants in the working fluid chamber of a Stirling engine is highly undesirable because these lubricants, when entrained in the working fluid, can irreversibly contaminate the regenerator of the Stirling engine. Thus, conventional engine lubricants can not be effectively employed to lubricate the pistons of a conventional Stirling engine. However, the solution of employing non-lubricated teflon piston rings in a Stirling engine has its own drawbacks. In particular, the physical properties of teflon (particularly its low melting point) place an upper temperature limit at which the piston cylinder can be maintained without damaging the teflon ring. This problem is especially pronounced in parallel Stirling engines employing double-ended pistons because the piston ring must be located proximal the working fluid chambers at each end of the pistons. Thus, a significant disadvantage of using teflon piston rings in a parallel Stirling engine is that the working fluid can not be heated to its optimum temperature without damaging the teflon piston rings.

A further disadvantage of prior art Stirling engines is the inefficiency of locating the heat exchangers remotely from the expanding and compression cylinders. Although spacing the heat exchangers from the expansion and compression cylinders allows for adequate heat exchange between the working fluid and the heat transfer fluid (i.e., the heating or cooling source), such a configuration does not allow for heat to be conducted directly from the physical structure of the heat exchanger to the physical structure of the cylinder assembly.

A still further disadvantage of prior art Stirling engines is their inability to rapidly vary the power output of the engine.

OBJECTS AND SUMMARY OF THE INVENTION

Responsive to these and other problems, it is an object of the present invention to provide an apparatus for converting between rotary and reciprocal motion without imparting a significant bending moment on a rotating drive shaft of the apparatus.

A further object of the present invention is to provide a dynamically balanced apparatus for converting between rotary and reciprocal motion.

A still further object of the present invention is to provide an apparatus for converting between rotary and reciprocal motion that has a more compact and robust construction than prior art devices.

An even further object of the present invention is to provide a parallel Stirling engine which employs a unique piston rod arrangement wherein the piston rod does not extend through a wall that defines the working fluid chamber.

Still a further object of the present invention is to provide a Stirling engine having a heat exchanger which is integral with the cylinder assembly to thereby allow heat to be directly conducted from the physical structure of the heat exchanger to the physical structure of the cylinder assembly.

Another object of the present invention is to provide a system which lubricates the pistons of a Stirling engine without causing contamination of the regenerator.

Still another object of the present invention is to provide a Stirling engine having the ability to rapidly vary the power output of the engine.

It should be noted that the above-listed objects need not all be accomplished by the invention claimed herein and other objects and advantages of this invention will be apparent from the following description of the invention and appended claims.

In accordance with one embodiment of the present invention, a motion converting apparatus is provided. The motion converting apparatus generally comprises an elongated shaft, a pair of spaced-apart cam disks, a reciprocating piston, and a pair of cam engagement bearings. The elongated shaft is adapted for rotation on a shaft axis. The cam disks are coupled to the shaft for rotation therewith and each present an inwardly facing curved cam surface. The piston is positioned generally between the inwardly facing cam surfaces and is adapted for linear reciprocal motion in a direction at least substantially parallel to the shaft axis. The can engagement bearings are coupled to the piston for reciprocal motion therewith. Each of the bearings rollingly contact a respective cam surface. The piston is positioned generally between the bearings.

In accordance with another embodiment of the present invention, an engine is provided. The engine generally comprises an elongated drive shaft, a pair of spaced apart cam disks, a plurality of reciprocating pistons, a pair of bearing assemblies for each piston, and a plurality of piston rod assemblies. The elongated drive shaft is adapted for rotation on a shaft axis. The cam disks are each coupled to the shaft for rotation therewith and each present a curved cam surface. The curved cam surfaces face generally inwards towards one another. The reciprocating pistons are positioned between the cam surfaces and are adapted for linear reciprocal motion in a direction at least substantially parallel to the shaft axis. The pistons are spaced generally symmetrically around the shaft axis. One pair of bearing assemblies is associated with each piston. Each bearing assembly comprises a housing and roller bearings supported for rotation relative to the housing. Each roller bearing in each bearing assembly contacts a respective one of the cam surfaces. Each of the pistons is positioned generally between the pair of bearing assemblies associated with that piston. Each of the piston rod assemblies couples one of the pistons to the pair of bearing assemblies associated with that piston.

In accordance with a further embodiment of the present invention, an engine generally comprising a housing, a cylinder assembly, and a piston is provided. The housing at least partly defines an inner chamber. The cylinder assembly is disposed in the inner chamber and at least partly defines an internal cylinder chamber disposed generally within the cylinder assembly and an external chamber disposed generally outside the cylinder assembly. The internal cylinder chamber and external chamber are at least substantially fluidically isolated from one another. The cylinder assembly presents an internal cylinder wall which at least partly defines the internal cylinder chamber. The piston is shiftably disposed in the internal cylinder chamber and presents a sealing surface at least substantially sealingly contacting the internal cylinder wall. The piston separates the internal cylinder chamber into a working chamber and a piston rod chamber. The working chamber and the piston rod chamber are at least substantially fluidically isolated from one another.

In accordance with a still further embodiment of the present invention, a cylinder assembly for a Stirling engine is provided. The Stirling engine utilizes thermal energy transferred between a working fluid and a heat transfer fluid to generate mechanical energy via a reciprocating piston. The cylinder assembly generally comprises a piston chamber wall, a heat transfer chamber, a heat exchanger, and a thermally conductive wall. The piston chamber wall at least partially defines an internal cylinder chamber. The internal cylinder chamber is adapted to shiftably receive the reciprocating piston. The piston chamber wall is adapted to cooperate with the piston to at least partly define a working fluid chamber of variable volume within the cylinder assembly. The heat transfer chamber is fluidically isolated from the working fluid chamber. The heat exchanger is at least partly disposed in the heat transfer chamber and defines a working fluid passageway fluidically communicating with the working fluid chamber. The heat exchanger is adapted to facilitate the transfer of heat between the heat transfer fluid in the heat transfer chamber and the working fluid flowing through the working fluid passageway. The thermally conductive wall defines at least a portion of the heat transfer chamber and is physically coupled to the piston chamber wall. The thermally conductive wall is operable to conduct heat between the heat transfer chamber and the piston chamber wall.

In yet another embodiment of the present invention, a double-barrel Stirling engine is provided. The double-barrel Stirling engine generally comprises an elongated drive shaft, a pair of spaced-apart inner cam disks, a pair of spaced-apart outer cam disks and a power actuator. The elongated drive shaft is adapted for rotation on a shaft axis. The inner cam disks are coupled to the drive shaft for rotation therewith and each present a generally inwardly facing curved inner cam surface. The outer cam disks are coupled to the drive shaft for rotation therewith and each present a generally inwardly facing curved outer cam surface. The power actuator is operable to rotate the inner and outer cam disks relative to one another.

In accordance with yet still another embodiment of the present invention, a Stirling engine having an expansion piston positioned for linear reciprocal movement in an expansion cylinder and a compression piston positioned for linear reciprocal movement in a compression cylinder is provided. The pistons reciprocate at substantially the same rate. The reciprocal motion of one of the pistons trails the reciprocal motion of the other of the pistons in accordance with a piston phase angle. The Stirling engine generally comprises a first member, a second member, a output member, and means for selectively shifting one of the first or second members relative to the other members. The first member is adapted to be rotated by the expansion piston. The second member is adapted to be rotated by the compression piston. The output member is cooperatively rotated by the first and second members and provides a power output. Selective shifting of the members by the means for selectively shifting causes the piston phase angle to change, thereby varying the power output of the Stirling engine.

BRIEF DESCRIPTION OF THE DRAWING FIGURES

Preferred embodiments of the invention are described in detail below with reference to the attached drawing figures, wherein.

Figure 21:
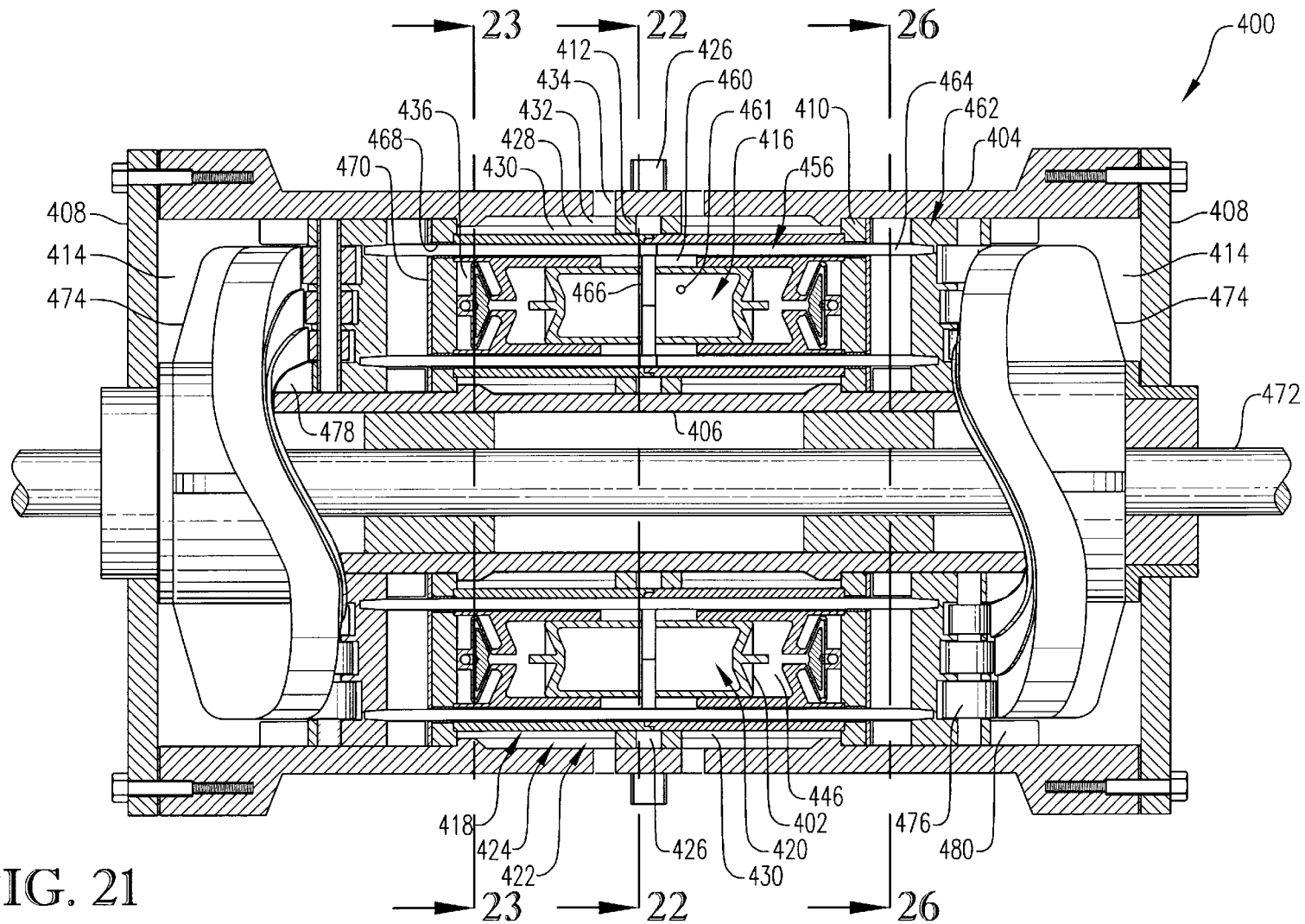
FIG. 21 is a partial sectional side view of the barrel-type Stirling engine constructed in accordance with the principles of the present invention and employing the novel motion converting apparatus illustrated in FIGS. 1–14.
Figure 24:
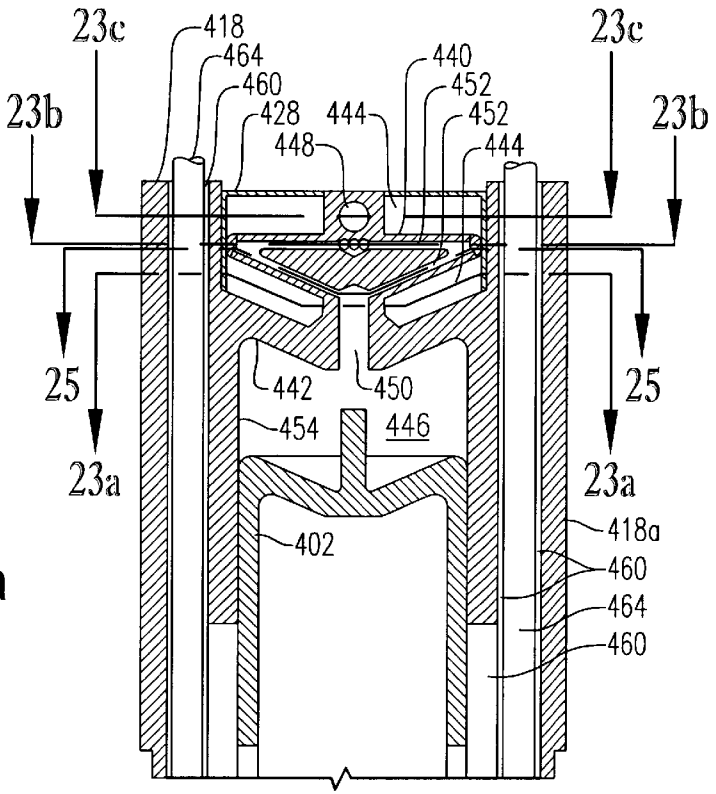
Figure 23:
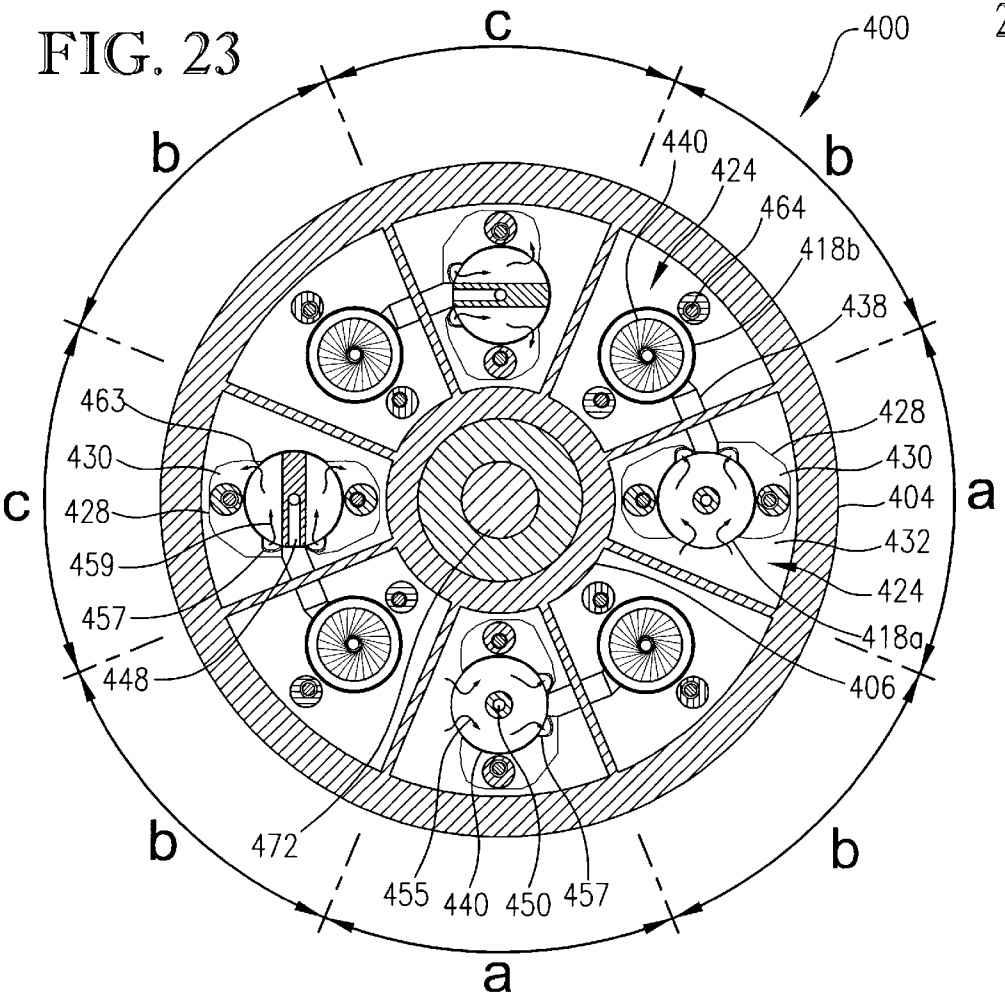
Figure 26:
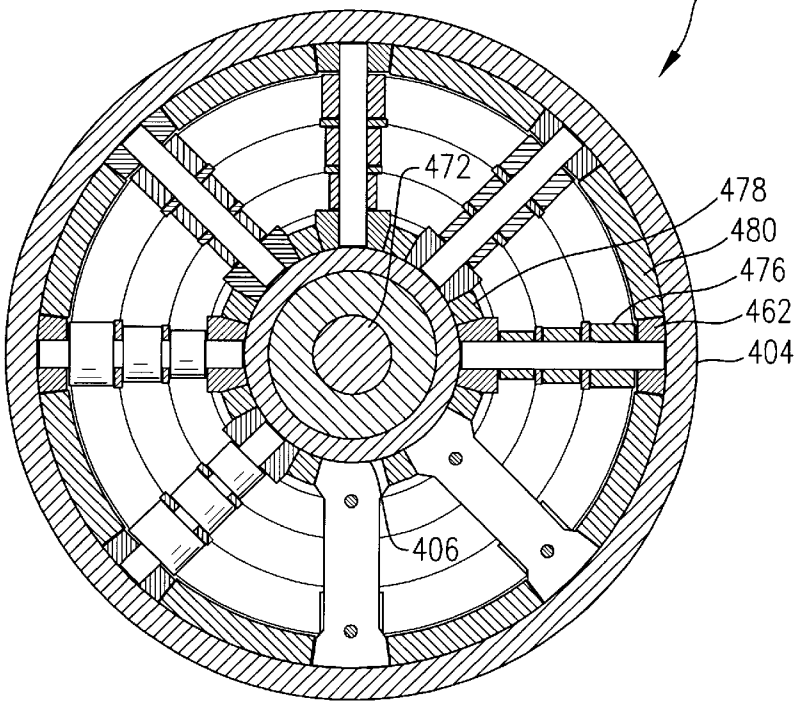
Figure 25:
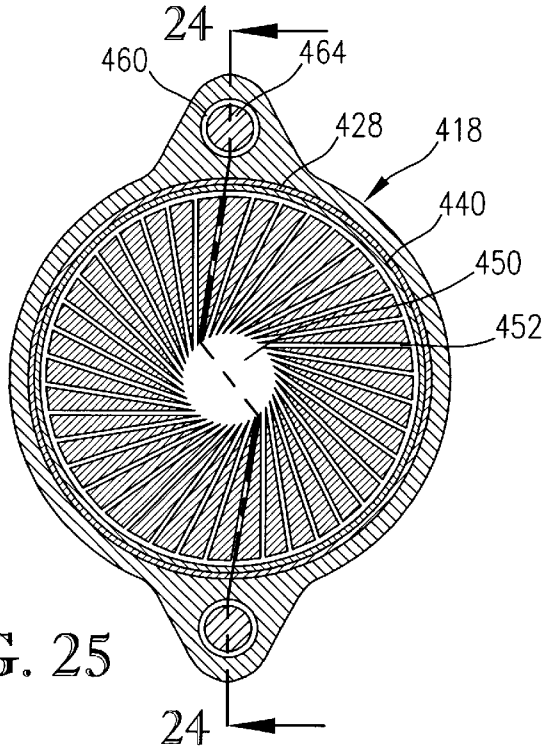
Figure 27:
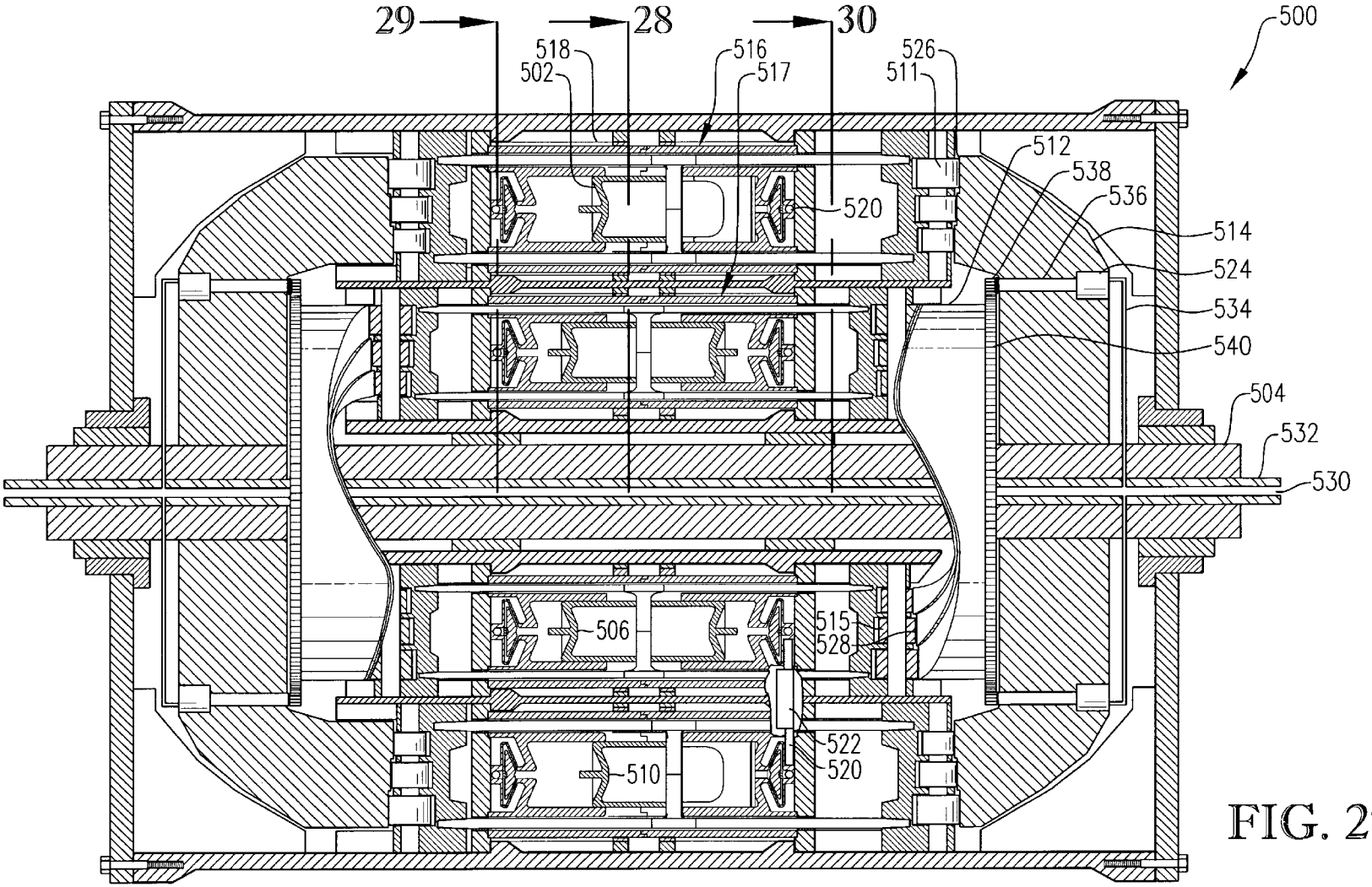
Figure 28:
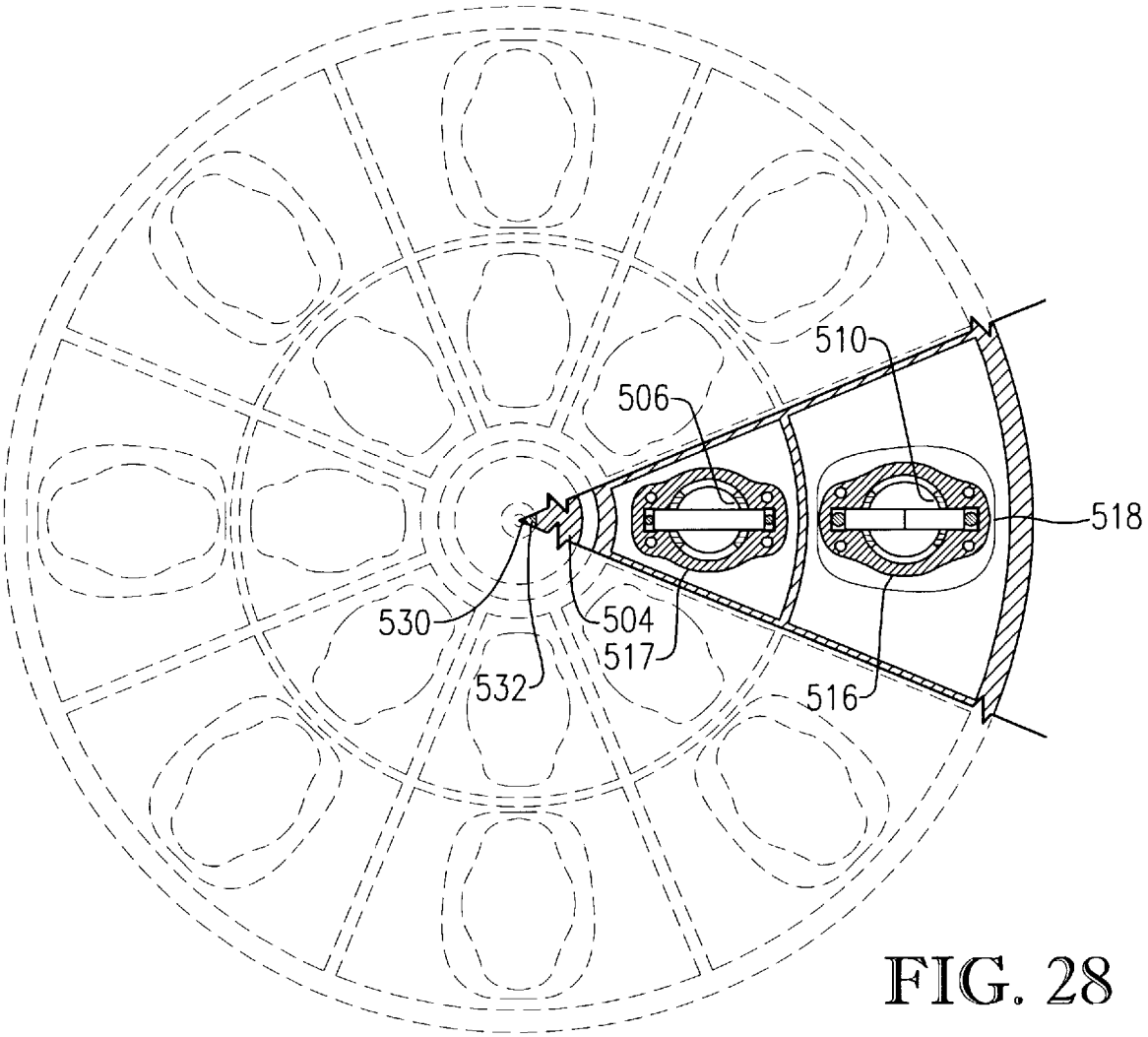
Figure 29:
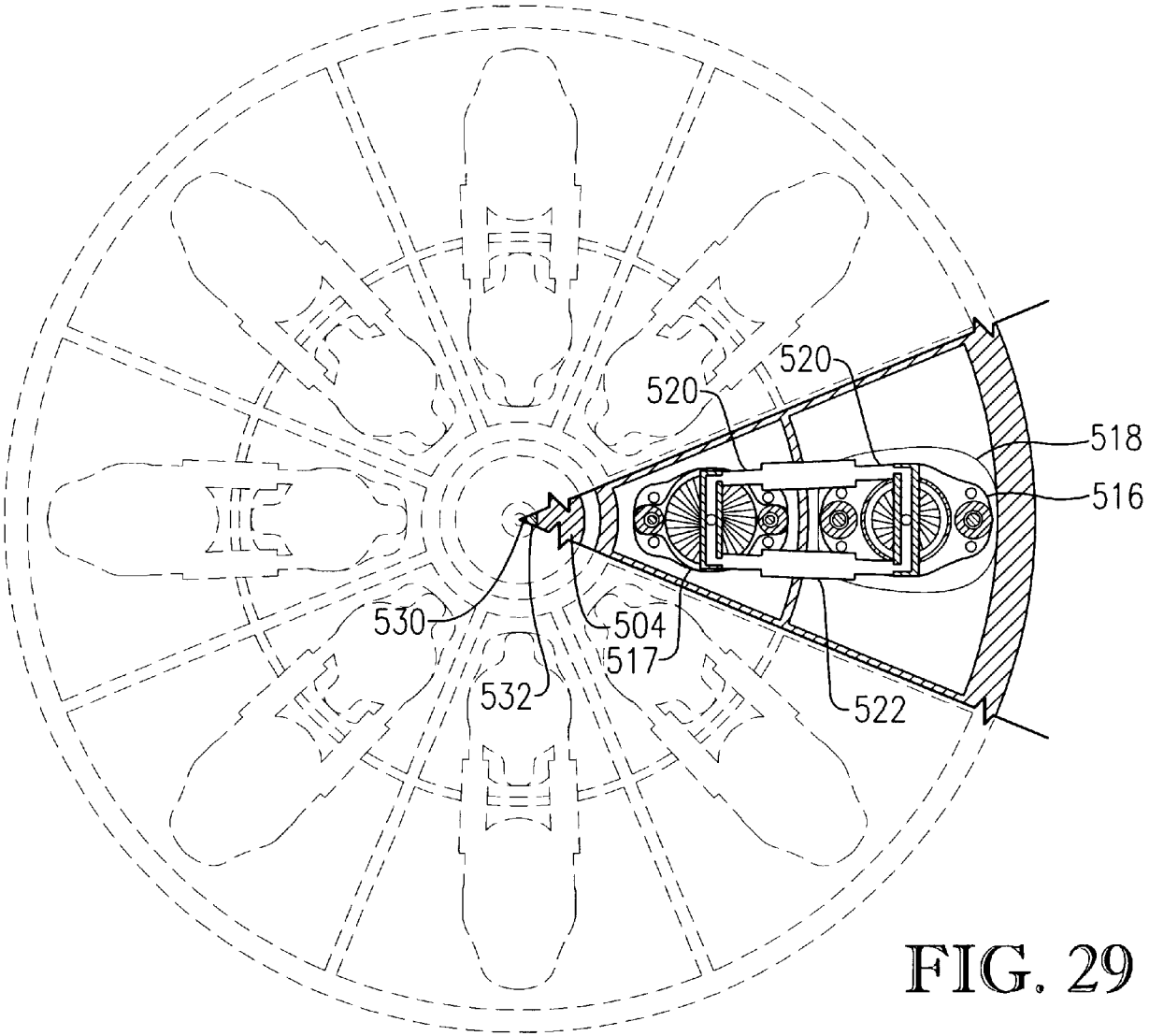
Figure 30:
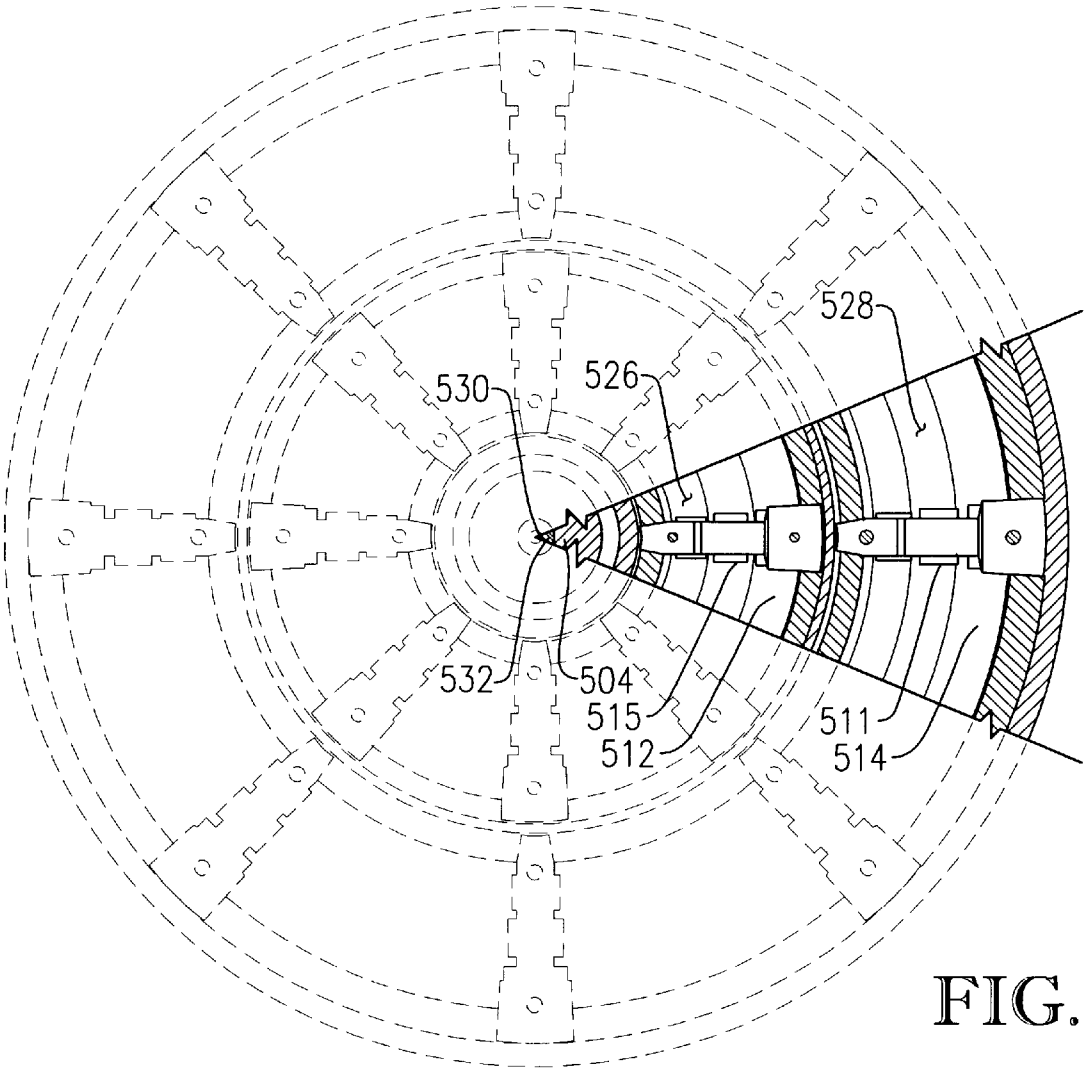
Figure 31:
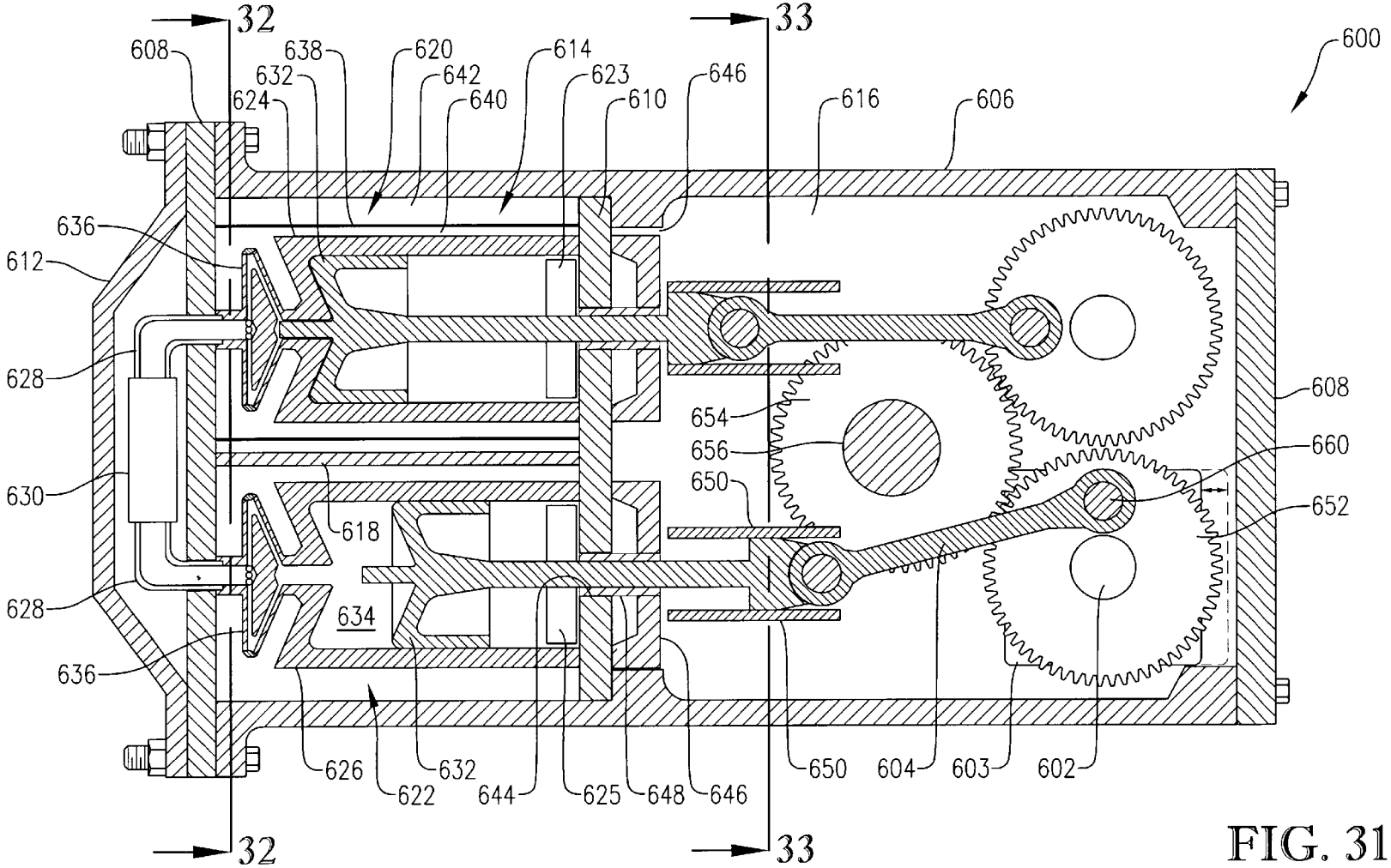
Figure 33:
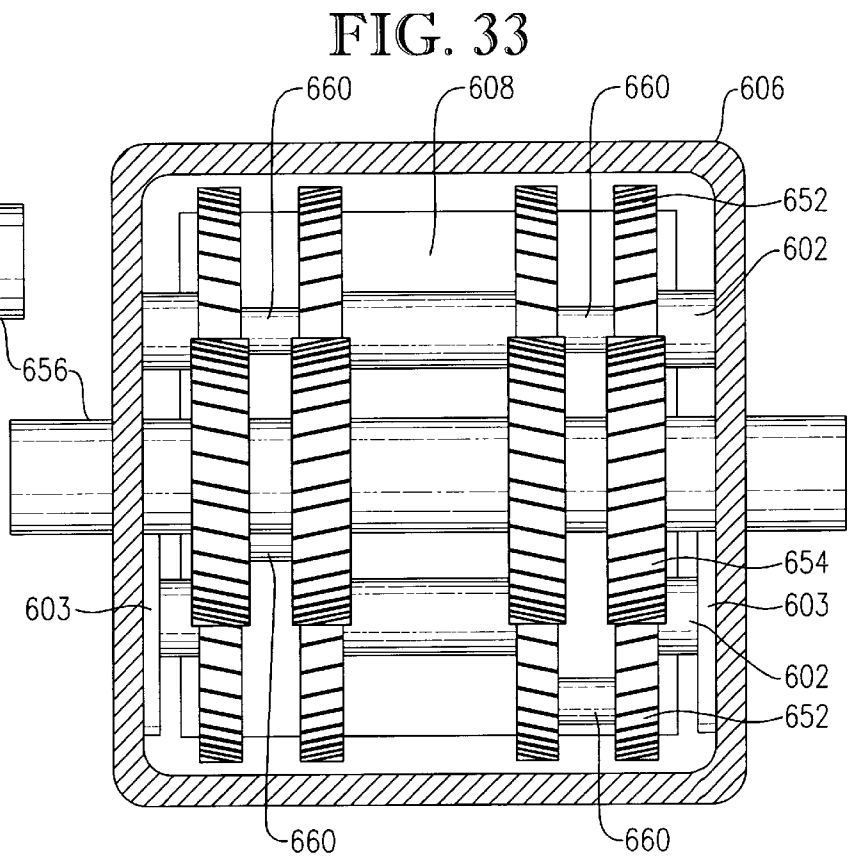
Figure 32:
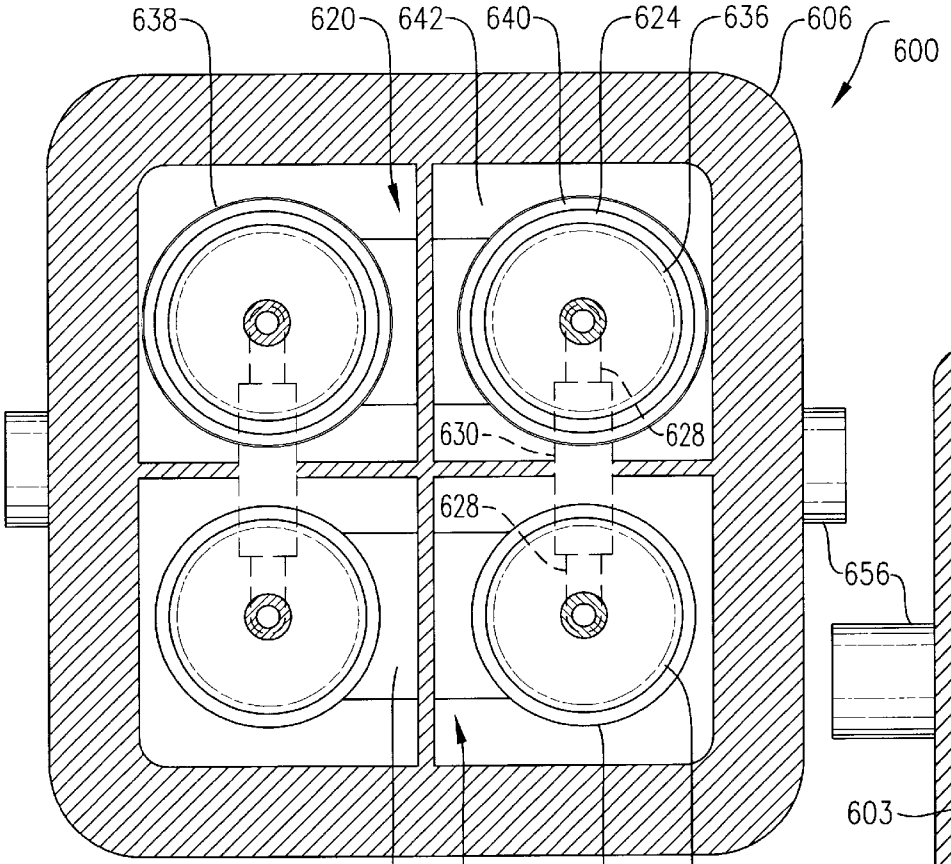

FIG. 23 is a multiple partial sectional view of the Stirling engine taken generally along line 23—23 in FIG. 21, however, FIG. 23 includes three different sections (a, b, and c) taken along line 23*a*—23*a*, 23*b*—23*b*, and 23*c*,—23*c* in FIG. 24, these different sections illustrate different portions of the heat exchanger and the cylinder assembly;

FIG. 24 is a sectional side view of the cylinder assembly and integral heat exchanger;

FIG. 25 is a sectional view of the cylinder assembly and integral heat exchanger taken along line 25—25 in FIG. 24;

FIG. 26 is a partial sectional view of the Stirling engine taken generally long line 26—26 in FIG. 21, showing various sectional and non-sectional views of the bearing assemblies as they are received in the cross heads for controlled linear reciprocal motion within the engine;

FIG. 27 is a partial sectional side view of a double-barrel Stirling engine constructed in accordance with the principles of the present invention;

FIG. 28 is a sectional view of the double-barrel Stirling engine taken along line 28 in FIG. 27, showing the radial arrangement of the expansion and compression cylinders;

FIG. 29 is a sectional view of the double-barrel Stirling engine taken along line 29 in FIG. 27, showing the manner in which the working fluid is transferred between adjacent expansion and compression cylinders;

FIG. 30 is a sectional view of the double-barrel Stirling engine taken along line 30 in FIG. 27, showing inner and outer bearing assemblies being slidably received in their respective crossheads for linear reciprocal motion within the engine;

FIG. 31 is a partial sectional side view of a crank-type Stirling engine constructed in accordance with the principles of the present invention;

FIG. 32 is a sectional view of the crank-type Stirling engine taken along line 32—32 in FIG. 31, showing the arrangement of the expansion and compression cylinders; and FIG. 33 is a sectional view of the crank-type Stirling engine taken along line 33—33 in FIG. 31, showing the manner in which the drive shaft is rotated by the crank gears with certain components being removed for purposes of clarity.

DETAILED DESCRIPTION OF THE PREFERRED EMBODIMENTS

Referring initially to FIGS. 1–4, the structural framework 50 of a motion converting apparatus constructed in accordance with an embodiment of the present invention is illustrated in detail. Structural framework 50 generally includes an outer case 52, an inner case 54, longitudinal bulkheads 56, outer transverse bulkheads 58, middle transverse bulkheads 60, and inner transverse bulkheads 62.

Outer and inner cases 52, 54 are generally tubular in shape with inner case 54 having an outside diameter which is smaller than the inside diameter of outer case 52. Inner case 54 is generally centrally disposed within outer case 52 and is cooperatively held in a fixed position relative to outer case 52 by longitudinal bulkheads 56, middle transverse bulkheads 60, and inner transverse bulkheads 62. Outer and inner cases 52, 54 each present respective ledges 64 to which middle transverse bulkheads 60 are coupled.

Each outer transverse bulkhead 58 is rigidly coupled to a respective opposite end of outer case 52 by any means known in the art such as, for example, bolting or welding. Each outer transverse bulkhead 58 defines a central opening which receives and holds a respective bushing fitting 66. Openings in bushing fittings 66 and inner case 54 cooperate to define an axial passageway 68 extending axially through structural framework 50. A drive shaft 70 is received in and extends through axial passageway 68. Drive shaft 70 is coupled for rotation relative to structural framework 50 via a plurality of bushings 72. Bushings 72 can be any bearing or bushing device known in the art for providing rotational movement of drive shaft 70 relative to structural framework 50 with minimal lateral or axial movement of drive shaft 70 within passageway 68.

Figure 1:
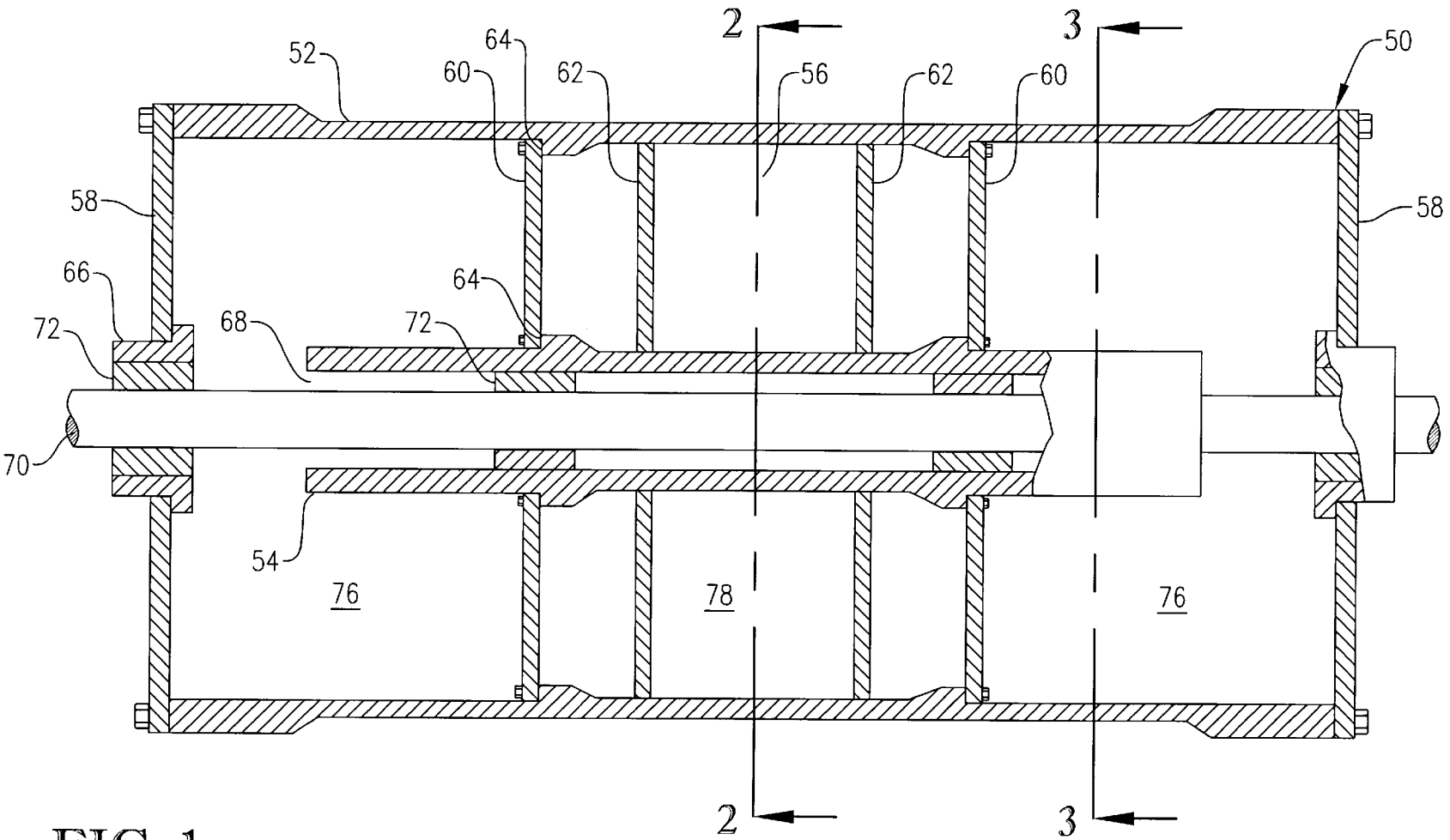
FIG. 1 is a sectional side view of the structural framework of a motion converting apparatus constructed in accordance with the principles of the present invention, with many of the internal components of the motion converting apparatus being removed to better illustrate the structural framework.
Figure 3:
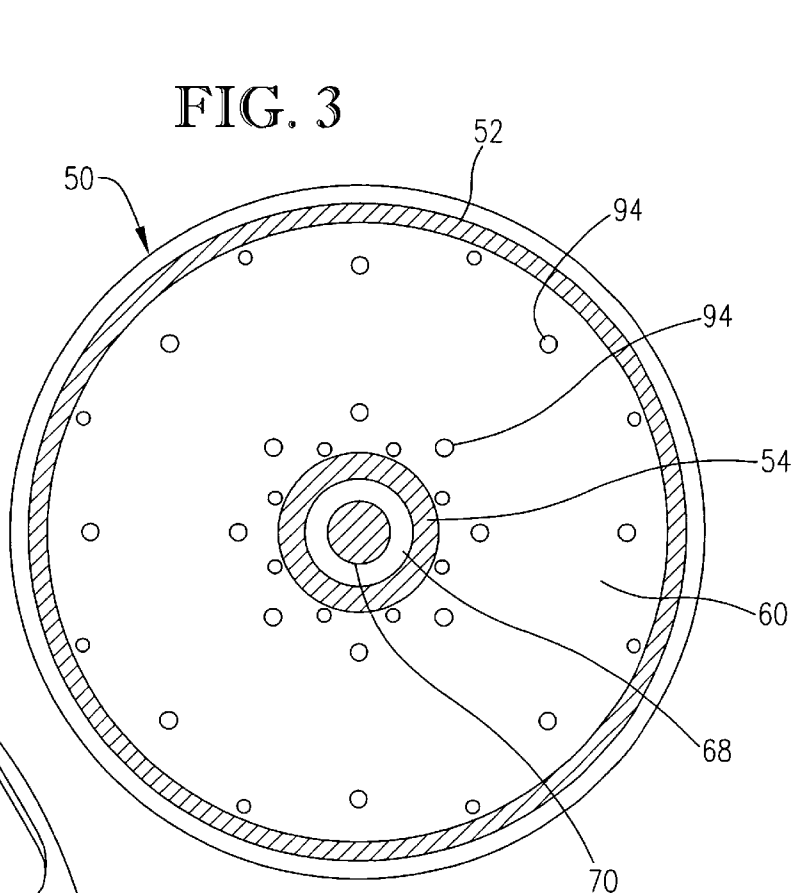
FIG. 3 is a sectional view of the structural framework taken along line 3—3 in FIG. 1.
Figure 2:
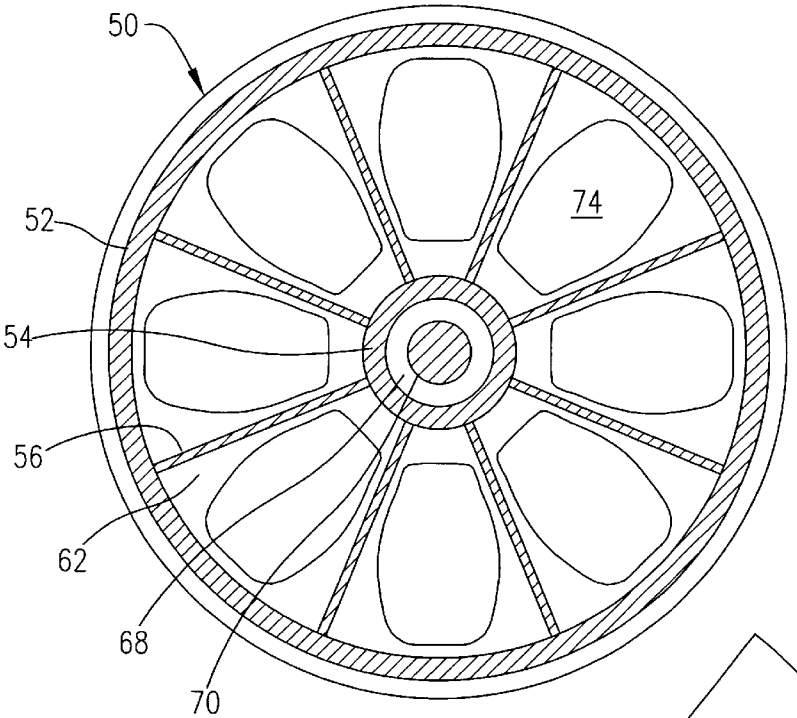
FIG. 2 is a sectional view of the structural framework taken along line 2—2 in FIG. 1.
Figure 4:
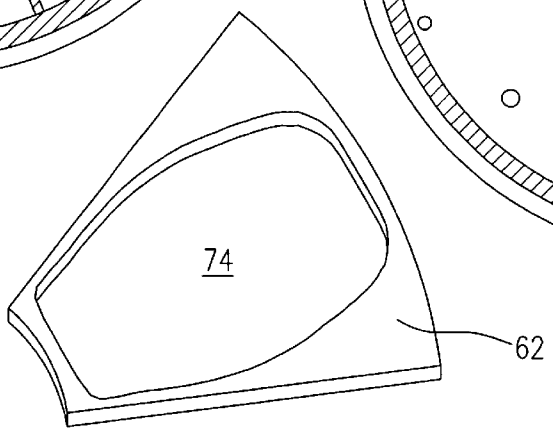
FIG. 4 is a an enlarged perspective view of a single inner transverse bulkhead.
Figure 5:
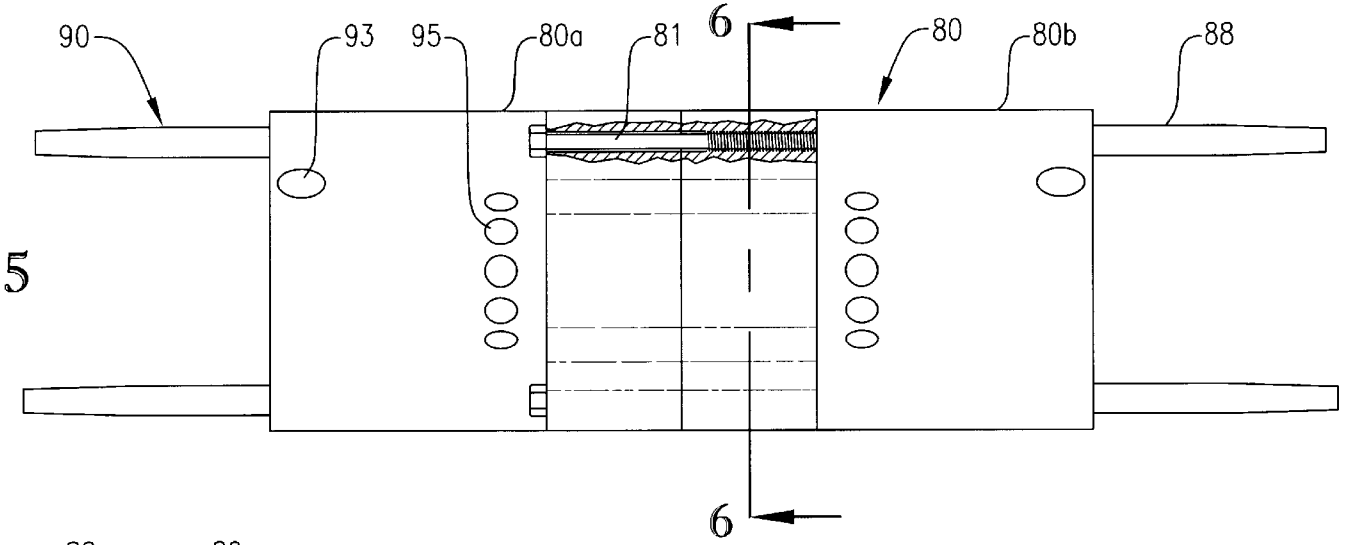
FIG. 5 is a side view of an assembled cylinder assembly piston, and piston rod assembly constructed in accordance with the principles of the present invention, with the piston and piston rod assembly being slidably received in the cylinder assembly, and a portion of the cylinder assembly being cut away to illustrate the manner in which the two cylinder halves are coupled to one another.
Figure 7:
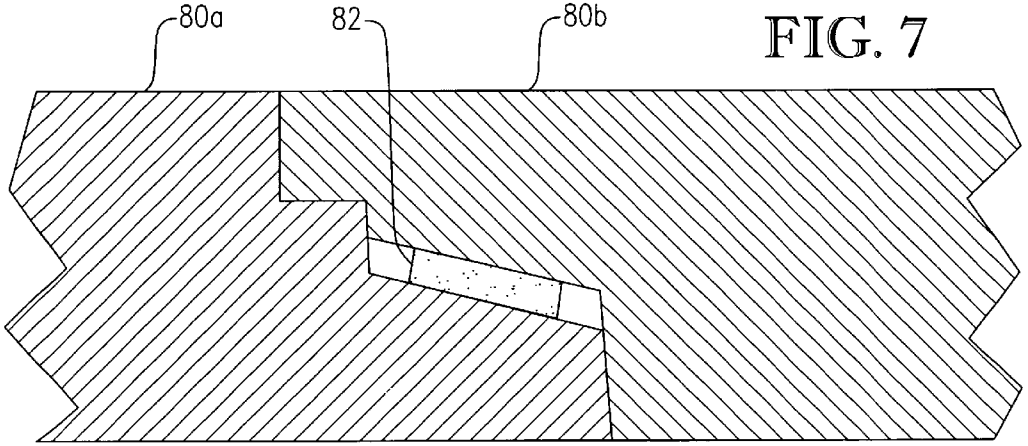
FIG. 7 is an enlarged sectional view showing details of the construction of the joint between the outer walls of the two cylinder halves.
Figure 6:
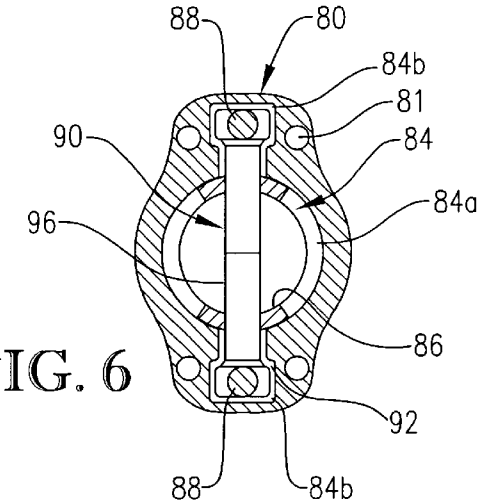
FIG. 6 is a sectional view of the assembled cylinder assembly, piston, and piston rod assembly taken along line 6—6 in FIG. 5.

As perhaps best shown in FIGS. 1 and 2, longitudinal bulkheads 56 comprise generally rectangular plates positioned symmetrically around inner case 54 and extending radially between outer and inner engine cases 52, 54, and longitudinally between middle transverse bulkheads 60. Longitudinal bulkheads 56 are preferably rigidly fixed to outer and inner cases 52, 54 by any means known in the art such as, for example, welding.

Inner transverse bulkheads 62 comprise generally pie-shaped plates (shown in FIG. 4) which are positioned between respective adjacent longitudinal bulkheads 56. Inner transverse bulkheads 62 can be rigidly fixed to outer case 52, inner case 54, and longitudinal bulkheads 56 by any means known in the art such as, for example, welding. Each inner transverse bulkhead 62 defines an opening 74 having a purpose which will be described in detail below. Middle transverse bulkheads 60 are rigidly coupled to ledges 64 of outer and inner cases 52, 54 by bolting, or other suitable attachment means.

Outer transverse bulkheads 58, middle transverse bulkheads 60, and outer case 52 cooperate to at least partly define a part of outer chambers 76 within structural framework 50. An inner chamber 78, positioned generally between middle transverse bulkheads 60, is at least partially defined by outer engine case 52, inner engine case 54, and middle transverse bulkheads 60. Thus, middle transverse bulkheads 60 divide the interior space in structural framework 50 into outer chambers 76 and inner chamber 78.

Referring now to FIGS. 5–8 in combination with FIGS. 1–2, a cylinder assembly 80 (shown in FIGS. 5 and 6) is configured to be received in inner chamber 78 (shown in FIG. 1) when the motion converting apparatus is fully assembled. Cylinder assembly 80 is adapted to be coupled to and extend between middle transverse bulkheads 60. Each cylinder assembly 80 is received in a respective correspondingly shaped opening 74 (shown in FIG. 2) in inner transverse bulkhead 62. Cylinder assembly 80 comprises two cylinder halves 80*a*, 80*b*. A cylinder seal 82 (shown in FIG. 7) is preferably disposed between the outer walls of cylinder halves 80*a*, 80*b* to ensure a fluid tight seal between cylinder halves 80*a*, 80*b*. When cylinder halves 80*a*, 80*b* are coupled together by bolt 81, cylinder assembly 80 defines an internal cylinder chamber 84 (shown in FIG. 6) within cylinder assembly 80.

Figure 9:
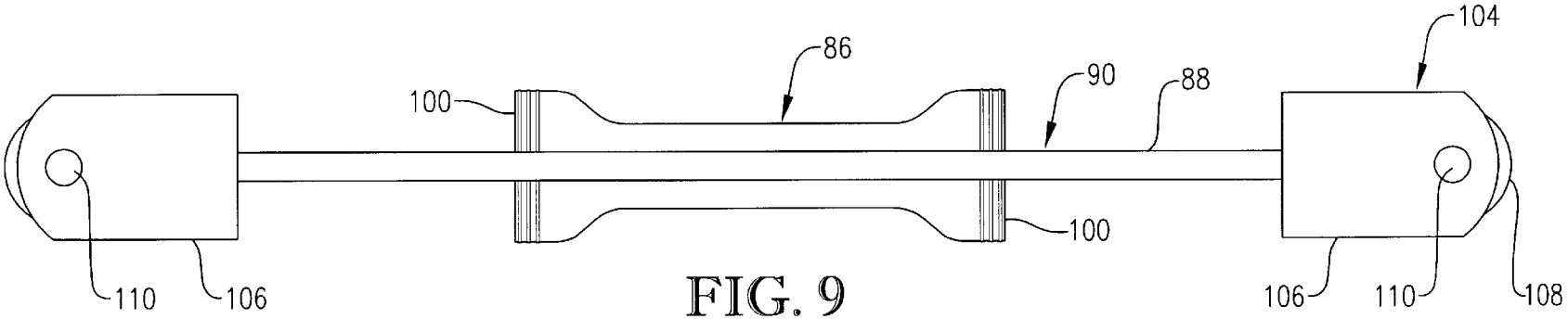
FIG. 9 is a side view of the primary linearly reciprocating components of the motion converting apparatus.
Figure 8:
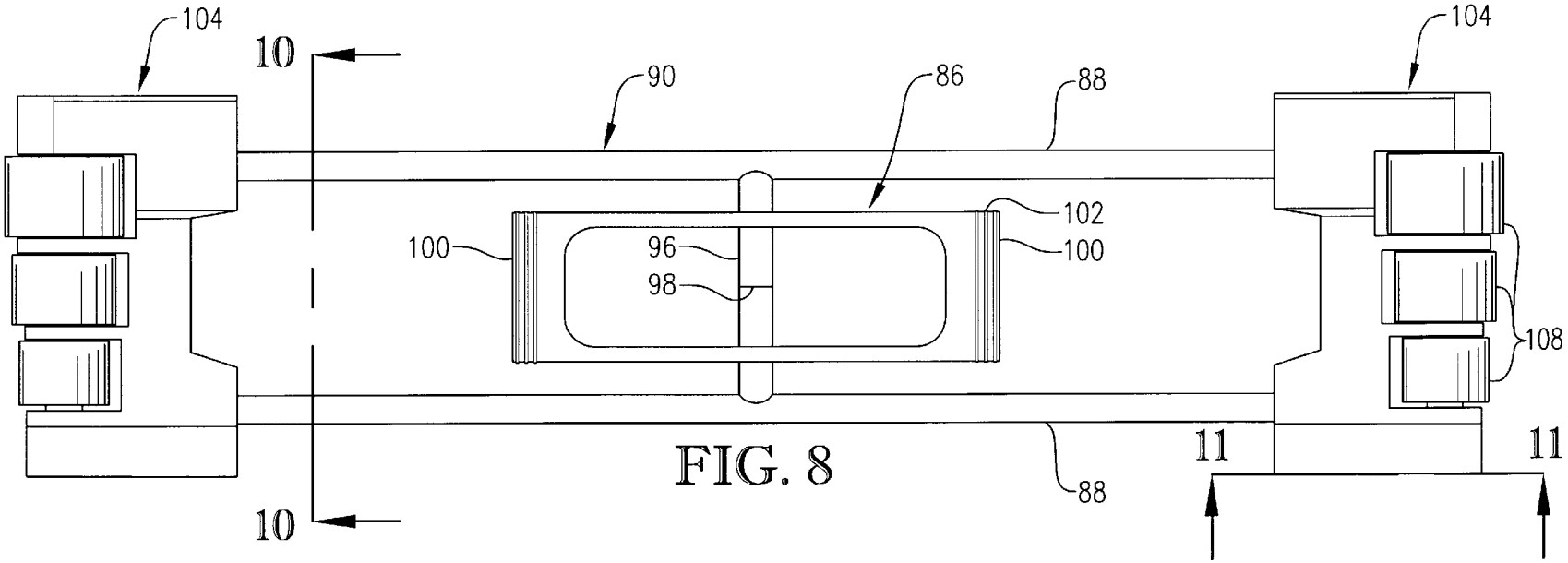
FIG. 8 is a top view of the primary linearly reciprocating components of the motion converting apparatus, showing the manner in which the piston, piston rod assembly, and bearing assemblies are coupled to one another.

Referring now to FIGS. 5–6 and 8–9 in combination, cylinder halves 80*a* and 80*b* (shown in FIG. 5) are joined over a double-ended piston 86 and an H-shaped piston rod assembly 90 (shown in FIGS. 8–9). Internal cylinder chamber 84 (shown in FIG. 6) includes a broad channel portion 84*a* for receiving piston 84 and two narrow channel portions 84*b* for receiving respective legs 88 of piston rod assembly 90. A piston rod chamber 92 (shown in FIG. 6) is formed by the gap between the outside surface of piston rod assembly 90 and the interior walls of cylinder assembly 80 which define internal cylinder chamber 84. Piston 86 and piston rod assembly 90 are slidably received in internal cylinder chamber 84 so that piston 86 and piston rod assembly 90 can reciprocate linearly relative to cylinder assembly 80.

Piston 86 is received generally between legs 88 of piston rod assembly 90. Piston 86 includes two opposing heads 100 equipped with respective sealing rings 102. Sealing rings 102 of piston heads 100 slidably and sealingly contact at least a portion of the internal wall that defines broad channel portion 84*a* of internal cylinder chamber 84 to thereby at least partly define opposing, spaced apart working chambers of internal cylinder chamber 84, with each working chamber being positioned adjacent a respective piston head 100. The working fluid chamber is at least substantially fluidically isolated from the piston rod chamber 92 by sealing rings 102. Thus, piston 86 and sealing rings 102 divide internal cylinder chamber 84 into two working fluid chambers (each adjacent opposite heads 100 of piston 86) and piston rod chamber 92 (adjacent piston rod assembly 90). Cylinder assembly 80 can define an outlet port 93 and a plurality of inlet ports 95 (shown in FIG. 5). Outlet and inlet ports 93, 95 are in fluid communication with internal cylinder chamber 84 and provide a means for injecting and exhausting fluids to and from the working fluid chambers.

Referring to FIGS. 8–9, piston rod assembly 90 has a generally H-shape configuration and comprises legs 88 and a cross member 96 coupled to and extending between legs 88. Cross member 96 can include two halves which are joined at a joint 98. Piston 86 and piston rod assembly 90 are coupled to one another for reciprocal movement with one another by extending the two halves of cross member 96 through respective openings in piston 86 and coupling the two halves of cross member 96 to one another by any means known in the art such as, for example, a threaded connection at joint 98.

Referring now to FIGS. 1–3, 5–6, and 8 in combination, cylinder assembly 80 (shown in FIG. 5) is adapted to be positioned between and coupled to middle transverse bulkheads 60 (shown in FIG. 1) when the motion converting apparatus in assembled. In such a configuration, cylinder assembly 80 and piston 86 are disposed in inner chamber 78

(shown in FIG. 1) while legs 88 of piston rod assembly are disposed partially within inner chamber 78 (shown in FIG. 1) and extend through piston leg openings 94 (shown in FIG. 3) in middle transverse bulkheads 60 and into outer chamber 76 (shown in FIG. 1).

Referring now to FIGS. 8–12, a pair of bearing assemblies 104 is associated with each piston 86 and piston rod assembly 90. Bearing assemblies 104 are coupled to opposite ends of legs 88 of piston rod assembly 90 so that each piston 86 is located generally between a respective pair of bearing assemblies 104. Bearing assemblies 104 generally include a bearing housing 106, a plurality of roller bearings 108, and a bearing shaft 110 for coupling roller bearings 108 to bearing housing 106. Bearing shaft 110 is fixed to bearing housing 106. Roller bearings 108 are free to rotate on bearing shaft 110 relative to bearing housing 106. Each bearing housing 106 defines a pair of rod-receiving openings 112 for receiving legs 88 of piston rod assembly 90 and rigidly coupling piston rod assembly 90 to bearing assembly 104.

Figure 13:
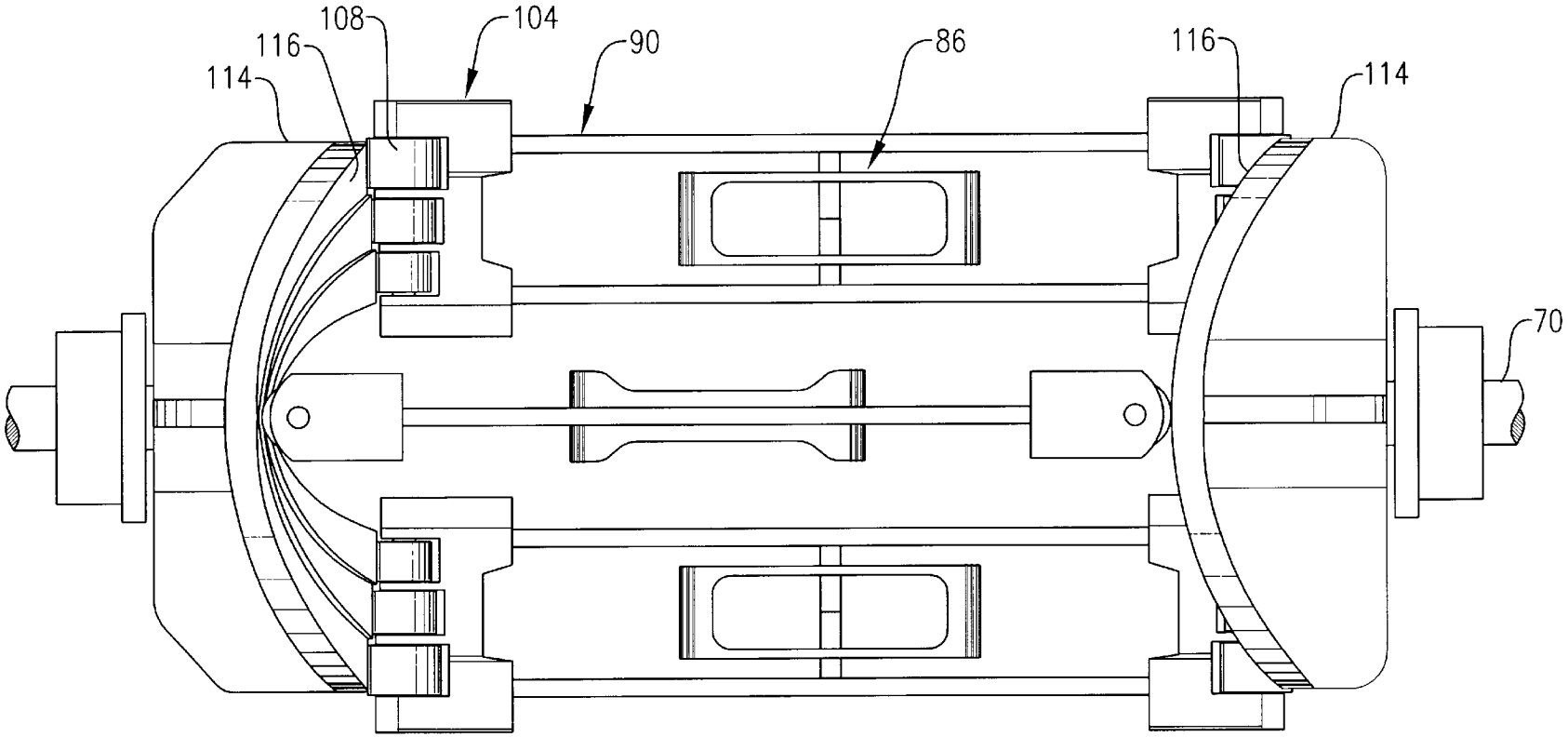
FIG. 13 is a side view of the primary internal components of the motion converting apparatus, with the structural framework and cylinder assemblies being removed to better illustrate the relationship of the primary reciprocating components (i.e., the pistons, piston rod assemblies, and bearing assemblies) and the primary rotating components (i.e., the cam disks and the drive shaft)
Figure 15:
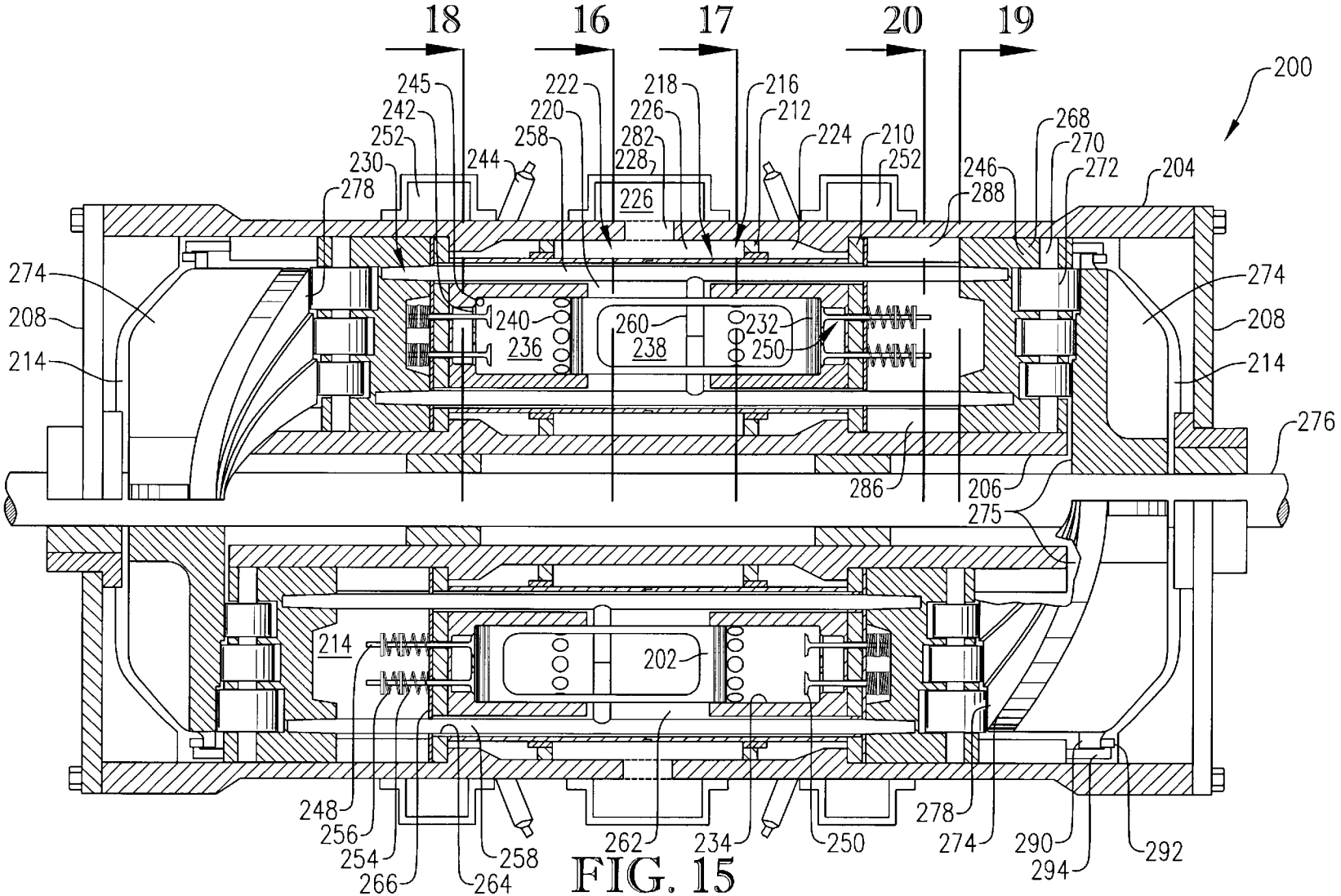
FIG. 15 is a partial sectional side view of a barrel-type diesel engine constructed in accordance with the principles of the present engine and employing the novel motion converting apparatus illustrated in FIGS. 1–14.

Referring now to FIG. 13 in combination with FIG. 1, cam disks 114 (shown in FIG. 13) are adapted to be positioned within outer chambers 76 (shown in FIG. 1). Cam disks 114 are fixedly coupled to drive shaft 70 for rotation therewith. Each cam disk 114 defines a generally cylindrical recess (not shown) for receiving a respective end portion of inner case 54 (shown in FIG. 1) when the motion converting apparatus is assembled with cam disks 114 being positioned in outer chambers 76. (The cylindrical recess in the cam disk is shown in FIG. 15 and will be described in further detail below, with reference to FIG. 15). As best seen in FIG. 13, cam disks 114 present generally opposing inwardly-facing curved cam surfaces 116 on which roller bearings 108 may roll. Preferably, a plurality of roller bearings 108 are associated with each bearing assembly 104 and each cam disk 114 presents a plurality of cam surfaces 116. Such a configuration reduces slippage of roller bearings 108 on curved cam surfaces 116. Bearing assembly 104, piston rod assembly 90, and piston 86 are disposed generally between opposing curved cam surfaces 116. Each cam disk 114 presents a generally circular outer perimeter. Cam disks 114 cooperate to define a generally cylindrical working space positioned between curved cam surfaces 116 and bounded in the radial direction by an imaginary surface, preferably a cylindrical imaginary surface, defined by and extending between the outer circumferential perimeters of cam disks 114. Pistons 86 and piston rod assemblies 90 are disposed in the working space defined between cam disks 114. Such a configuration allows for a more robust and compact motion converting apparatus when compared to conventional swash plate-type motion converting devices having the pistons located outside the working space.

Figure 14:
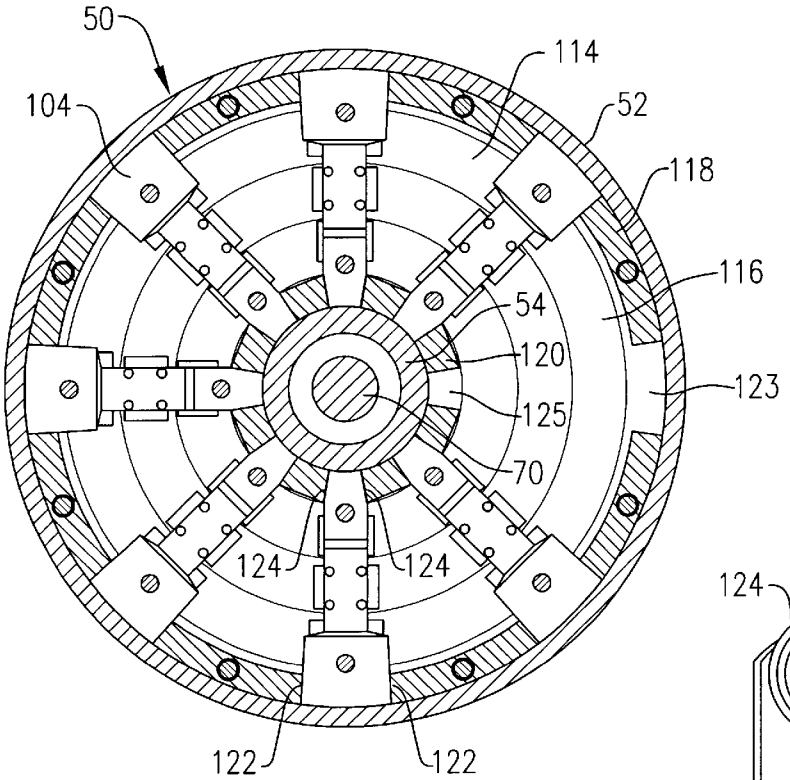
FIG. 14 is a partial axial sectional view of the motion converting apparatus, showing the cam disk being received in the structural framework and illustrating the cross heads which maintain the axial linear motion of the bearing assemblies in the structural framework.

Referring now to FIGS. 1, 11, and 13–14 in combination, as described above, piston 86, piston rod assembly 90, and bearing assembly 104 (shown in FIG. 13) are configured to reciprocate linearly relative to structural framework 50 (shown in FIG. 1) while being restricted from rotation relative to structural framework 50 by outer and inner crossheads 118, 120 (shown in FIG. 14). Conversely, drive shaft 70 and cam disks 114 are configured to rotate relative to structural framework 50 while being restricted from translational movement relative to structural framework 50. Referring to FIG. 13, by forcing piston 86 to reciprocate linearly relative to structural framework 50, roller bearings 108 press on curved cam surfaces 116 of cam disks 114, thereby causing cam disks 114 to rotate drive shaft 70. Conversely, if drive shaft 70 is rotated, curved cam surfaces 116 of cam disks 114 cause roller bearings 108 to roll along curved cam surfaces 116, thereby providing linear reciprocal motion of piston 86. When piston 86 has a working chamber disposed adjacent both heads 100 of piston 86, such conversion between reciprocal and rotary motion can be used either to drive piston 86 to do work on a fluid in the working chamber or to allow the fluid in the working chamber to drive piston 86.

Figure 10:
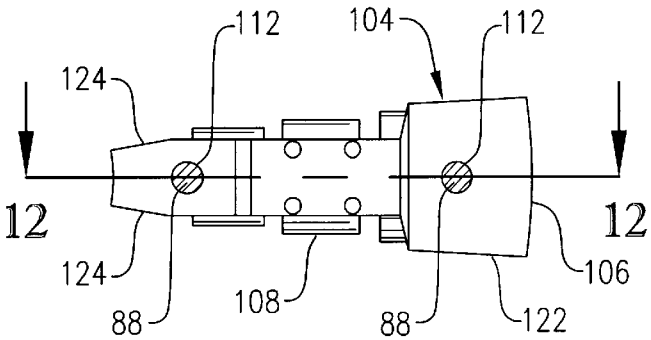
FIG. 10 is a bottom view of the bearing assembly taken along line 10—10 in FIG. 8.
Figure 12:
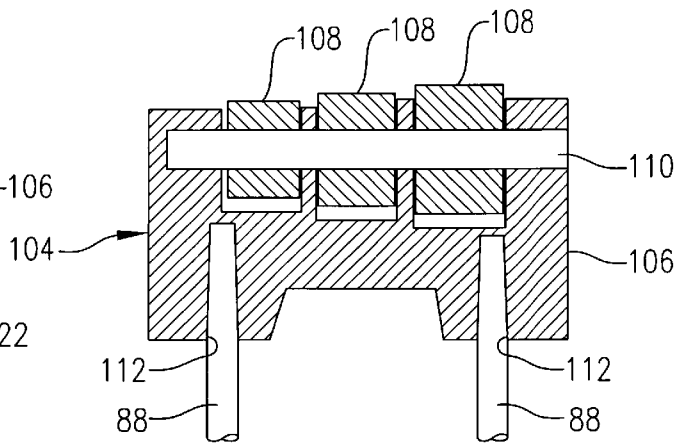
FIG. 12 is an enlarged sectional side view of the bearing assembly taken along line 12—12 in FIG. 10.
Figure 11:
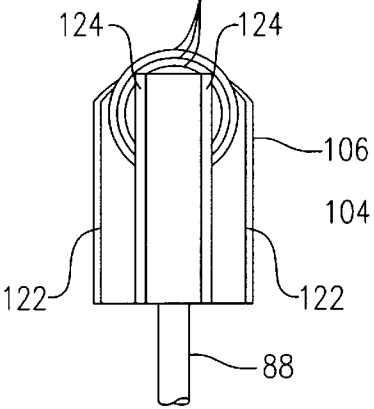
FIG. 11 is an end view of the bearing assembly taken along line 11—11 in FIG. 8.

Referring now to FIGS. 10–11 and 14, outer and inner crossheads 118, 120 (shown in FIG. 14) are coupled to outer and inner cases 52, 54, respectively. Outer gaps 123, between adjacent outer cross heads 118, and corresponding inner gaps 125, between adjacent inner crossheads 120 (shown in FIG. 14), are shaped to receive respective outer and inner sliding surfaces 122, 124 of bearing housing 106 (shown in FIGS. 10–11). Outer and inner crossheads 118, 120 allow for bearing housing 106 to reciprocate linearly relative to outer and inner cases 52, 54 while retraining non-linear motion of bearing housing 106 relative to outer and inner cases 52, 54. Thus, in operation, pistons 86, piston rod assembly 90, and bearing assemblies 104 reciprocate linearly along a line of action which is substantially parallel to the axis of rotation of drive shaft 70.

The motion converting apparatus illustrated in FIGS. 1–14 can convert reciprocal piston motion to rotary drive shaft motion when employed in an engine. Alternatively, the motion converting apparatus can convert rotary drive shaft motion to reciprocal piston motion when employed in a pump.

FIGS. 15–20 show a diesel engine 200 in accordance with an embodiment of the present invention. Diesel engine 200 employs a system for converting reciprocal to rotary motion which is substantially the same as the motion converting apparatus described above and illustrated in FIGS. 1–14. Diesel engine 200 of FIG. 15 preferably has a barrel-type configuration and employs a plurality of double-acting pistons 202. As used herein, the term "barrel-type" shall mean an engine configuration employing a plurality of linearly reciprocating pistons which an symmetrically spaced about a rotating drive shaft which they power, wherein the pistons reciprocate along a line of action which is substantially parallel to the axis of rotation of the drive shaft. As used herein, the term "double-acting piston" shall mean a single piston having two working ends, with each end positioned proximal a working chamber and adapted to receive energy from and/or impart energy to the contents of the working chamber.

Referring to FIG. 15, diesel engine 200 generally comprises an outer engine case 204, an inner engine case 206, outer transverse bulkheads 208, middle transverse bulkheads 210, and inner transverse bulkheads 212. Outer engine case 204, inner engine case 206, outer transverse bulkheads 208, and middle transverse bulkheads 210 at least partially define outer chambers 214. Outer engine case 204, inner engine case 206, and middle transverse bulkheads 210 cooperate to define an inner chamber 216 located generally between middle transverse bulkheads 210. Thus, middle transverse bulkheads 210 separate and fluidically isolate inner chamber 216 from outer chambers 214.

Figure 16:
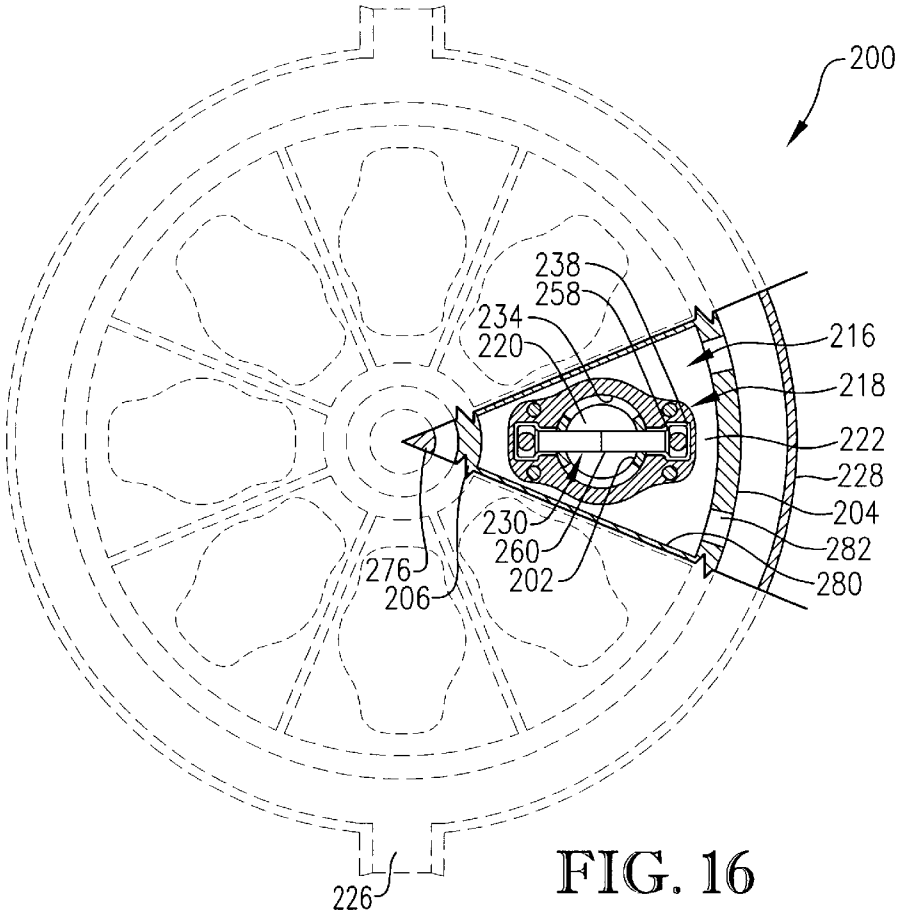
FIG. 16 is a sectional view of the diesel engine taken along line 16 in FIG. 15, showing the manner in which combustion air enters the inner chamber of the engine.

As shown in FIGS. 15 and 16, a plurality of cylinder assemblies 218 are disposed in inner chamber 216 and are coupled between middle transverse bulkheads 210. Cylinder assemblies 218 separate inner chamber 216 into an internal cylinder chamber 220 (disposed generally within chamber assembly 218) and an external chamber 222 (disposed generally outside of cylinder assembly 218). Cylinder assembly 218 is operable to fluidically isolate internal cylinder chamber 220 from external cylinder chamber 222.

Referring again to FIG. 15, external cylinder chamber 222 is divided into coolant chambers 224 and air chamber 226 by inner transverse bulkheads 212. Coolant chambers 224 and air chambers 226 are fluidically isolated from one another. Coolant chambers 224 provide a flow path for circulating a conventional coolant through engine 200. Air chamber 226 provides a flow path for air received in an intake manifold 228 to enter engine 200 for mixing with the fuel to promote combustion.

Internal cylinder chamber 220 is shaped to receive piston 202 and at least a portion of a piston rod assembly 230. Piston 202 includes two sets of sealing rings 232 disposed proximal respective ends of piston 202. Sealing rings 232 sealingly contact an internal wall 234 of cylinder assembly 218. Piston 202 and sealing rings 232 divide internal cylinder chamber 220 into a pair of combustion chambers 236 (located adjacent respective ends of piston 202) and a piston rod chamber 238. Combustion chambers 236 and piston rod chamber 238 are substantially fluidically isolated from one another.

Combustion chamber 236 varies in volume as piston 202 reciprocates within cylinder assembly 218 between a downstroke position wherein the volume of combustion chamber 236 is maximized and an upstroke position wherein the volume of combustion chamber 236 is minimized. Cylinder assembly 218 defines intake ports 240 for providing air to combustion chamber 236 and exhaust ports 242 for allowing combustion exhaust to escape combustion chamber 236.

When piston 202 is in the downstroke position, intake ports 240 communicate with combustion chamber 236 and allow air from air chamber 226 to be injected into combustion chamber 236. When piston 202 is in the downstroke position, a bearing assembly 246 located in outer chamber 214 contacts valve stems 248 of exhaust valves 250 to thereby open exhaust valves 250 and let exhaust ports 240 communicate with combustion chamber 236. Thus, when piston 202 is in the downstroke position, the air entering through intake port 240 forces the existing combustion exhaust out of combustion chamber 236 through exhaust port 242 and into exhaust gas chamber 252.

As piston 202 moves from the downstroke position towards the upstroke position, intake parts 240 are fluidically decoupled from combustion chamber 236 by piston 202 and sealing ring 232 and exhaust ports 242 are fluidically decoupled from combustion chamber 236 by exhaust valve 250 which is biased towards the closed position by primary and secondary valve springs 254, 256. Movement of piston 202 towards the upstroke position compresses the air in combustion chamber 236 until the temperature of the air is above the ignition temperature of diesel fuel. When piston 202 is at or near the upstroke position, diesel fuel is injected into combustion chamber 236 via fuel injector 244 and fuel port 245. The injected diesel fuel is ignited by the high temperature compressed air in combustion chamber 236, thereby causing rapid expansion in combustion chamber 236 which forces piston 202 to move towards the downstroke position.

In operation, as combustion of the diesel fuel alternates at opposite ends of double-acting pistons 202, pistons 202 are forced to reciprocate linearly. This linear reciprocal motion of piston 202 is transferred to the pair of bearing assemblies 246 located on opposite sides of piston 202 via piston rod assembly 230. Piston rod assembly 230 generally includes a pair of elongated legs 258 which extend axially on opposite sides of piston 202. Legs 258 are coupled to piston 202 and to one another by a cross member 260 which extends transversely between a middle portion of both legs 258 and through openings in piston 202. Cylinder assembly 218 defines a slot 262 for allowing cross member 260 to reciprocate within cylinder assembly 218. Each leg 258 extends through respective openings 264 in middle transverse bulkheads 210 so that a middle portion of each leg 258 is disposed in piston rod chamber 238 while the outer ends portions of each leg 258 are disposed in outer chambers 214. A sealing member 266 is preferably positioned proximal openings 264 to ensure that outer chamber 214 and piston rod chamber 238 remain at least substantially fluidically isolate from one another, even as leg 258 slides within opening 264.

Piston rod chamber 238, which is at least substantially fluidically isolated from combustion chamber 236, coolant chamber 224, air chamber 226, and outer chamber 214, is preferably at least partially filled with a lubricant operable to lubricate the interface between sealing rings 232 and internal wall 234 as well as the interface between sealing member 266 and leg 258. The lubricant in piston rod chamber 238 can be any conventional hydrocarbon-based lubricant or, alternatively, can be non-hydrocarbon lubricant such as water in liquid or gaseous form.

Bearing assemblies 246 are associated with each piston 202 via H-shaped piston rod assembly 230. Bearing assembly 246 are disposed in outer chamber 214 and are coupled to respective end portions of legs 258 of piston rod assembly 230. Each piston 202 is positioned generally between bearing assemblies 246 associated with that piston 202. Bearing assemblies 246 generally include a housing 268, a bearing shaft 270, and roller bearings 272. Roller bearings 272 are freely rotatable on shaft 270 relative to housing 268.

Cam disks 274 are disposed in respective outer chambers 214 of engine 200. Cam disks 274 are coupled to a common drive shaft 276 for rotation therewith. Each cam disk 274 receives a respective opposite end portion of inner engine case 206 in a cam disk recess 275. Outer chamber 214 preferably contains a conventional lubricant for lubricating cam disks 274 as well as drive shaft 276. Cam disks 274 present respective inwardly facing curved cam surfaces 278. Pistons 202 are positioned generally between curved cam surfaces 278 of cam disks 274.

When combustion of the fuel/air mixture in combustion chamber 236 causes roller bearings 272 to press against a sloped portion of curved cam surface 278, a torsional force is applied to drive shaft 276 via cam disk 274. This torsional force causes cam disks 274 and drive shaft 276 to rotate as roller bearing 272 rolls on cam surface 278. Thus, the linear reciprocation of pistons 202 is converted into rotary motion of drive shaft 276 via the interface of roller bearings 272 and cam surfaces 278.

Figure 17:
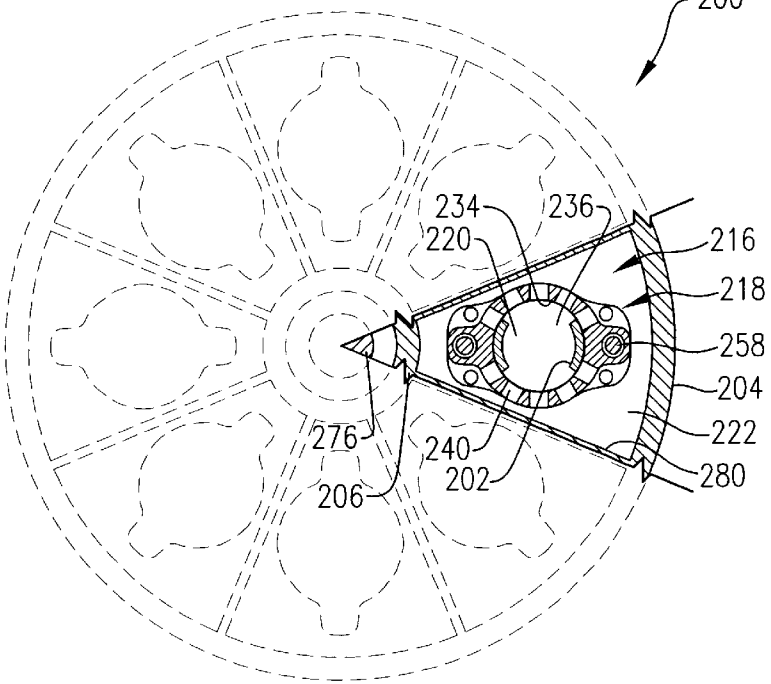
FIG. 17 is a sectional view of the diesel engine taken along line 17 in FIG. 15, showing the manner in which combustion air enters the combustion chamber of the cylinder assembly.
Figure 19:
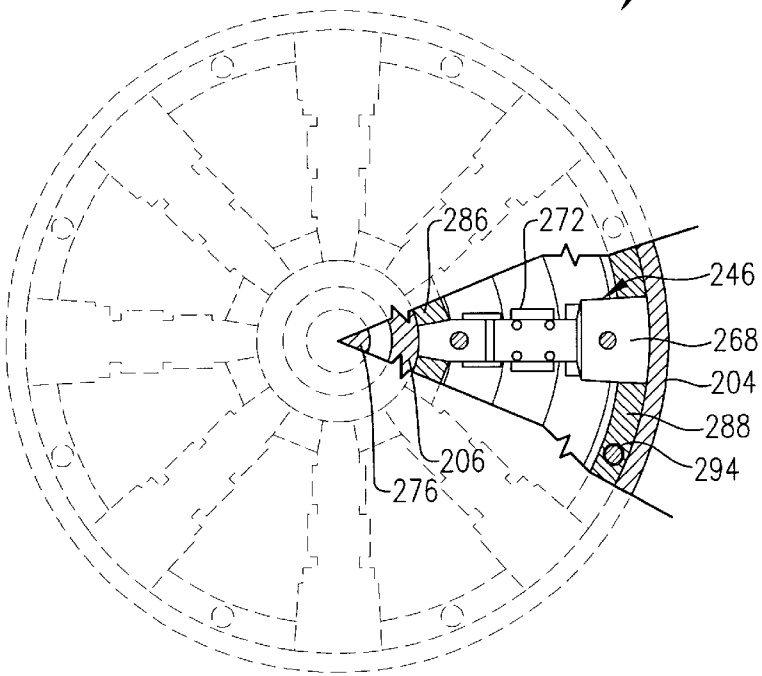
FIG. 19 is a sectional view of the diesel engine taken along line 19 in FIG. 15, showing the bearing assemblies being received in the cross heads for controlled linear reciprocal motion within the engine.
Figure 18:
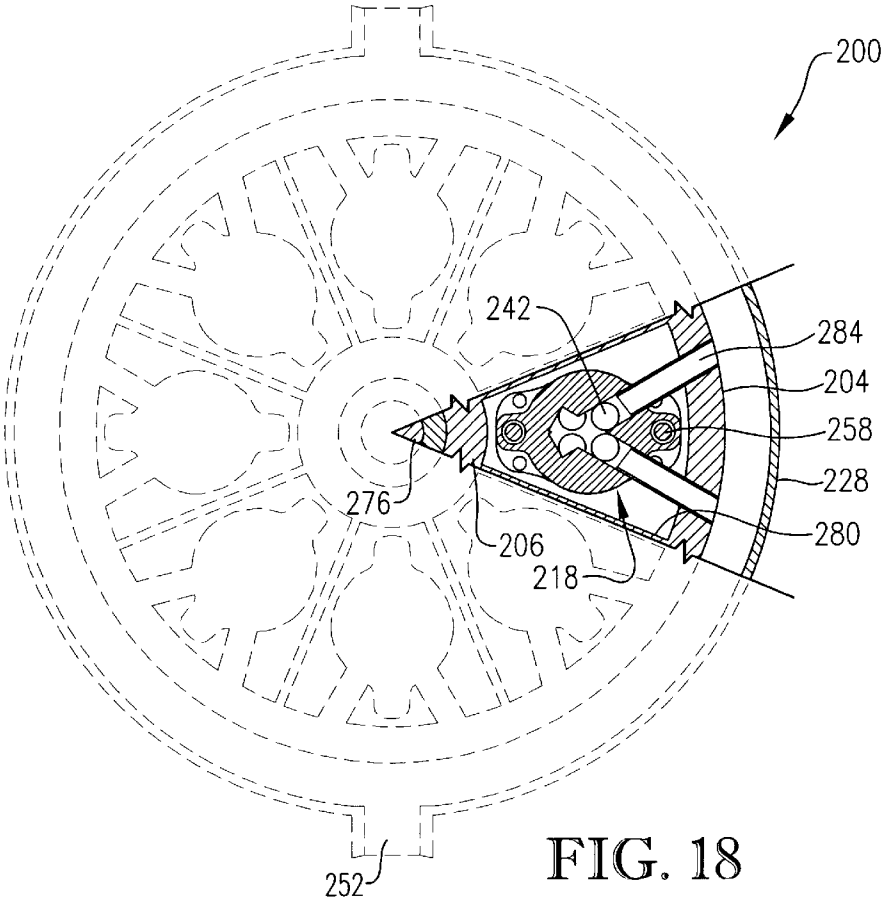
FIG. 18 is a sectional view of the diesel engine taken along line 18 in FIG. 15, showing the manner in which combustion exhaust exits the combustion chamber and the engine.

Referring now to FIG. 16, the plurality of cylinder assemblies 218 are separated from one another by radially extending longitudinal bulkhead 280. Combustion air is provided to each cylinder assembly 218 via air chamber 226 and openings 282 in outer engine case 204. FIG. 17 better illustrates the manner in which air is provided to combustion chamber 236 via intake ports 240 in cylinder assemblies 218. FIG. 18 better illustrates the manner in which exhaust gas is expelled from combustion chambers 236 via exhaust ports 242, exhaust channels 284, and exhaust gas chamber 252. FIG. 19 better illustrates the manner in which bearing assemblies 246 are restrained from non-linear translation by inner and outer crossheads 286, 288 which are coupled to inner and outer engine cases 206, 204 respectively and slidably receive bearing assemblies 246.

Figure 20:
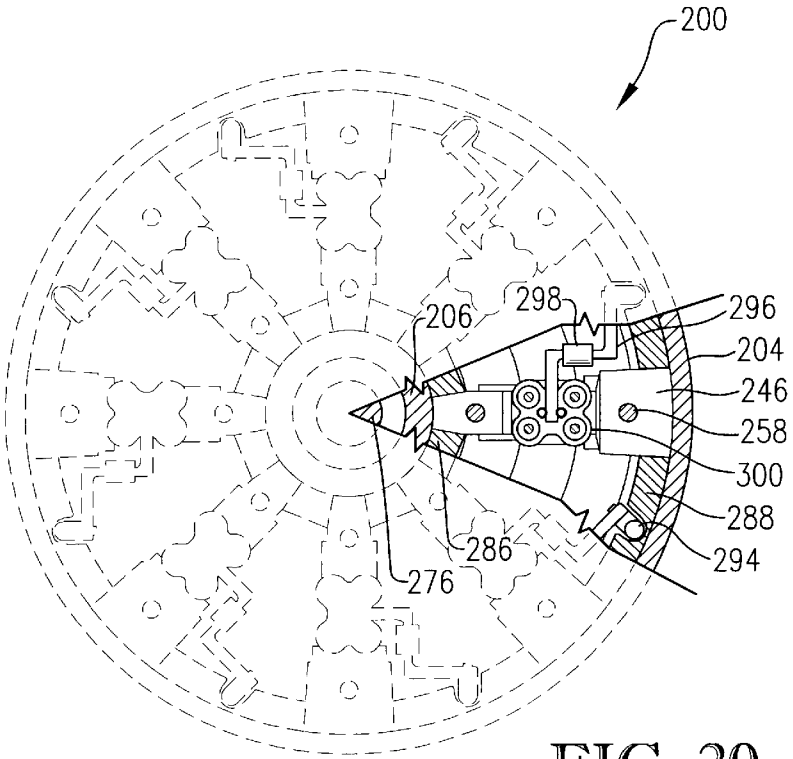
FIG. 20 is a sectional view of the diesel engine taken along line 20 in FIG. 15, illustrating an alternative system (not fully shown in FIG. 15) for controlling the opening and closing of the exhaust valves.

FIG. 20 illustrates an alternative system for controlling the opening and closing of exhaust valves 250. Referring now to FIG. 15, this alternative exhaust valve controlling systems includes a valve cam 290 located on the outer perimeter of cam disk 274 and a cam roller 292 for travelling on an engagement surface of valve cam 290. Roller 292 is coupled to a valve rod 294. As shown in FIG. 20, a valve rod 294 is slidably received in a channel in outer cross head 288. An opposite end of valve rod 294 is coupled to a crank arm 296. Crank arm 296 is adapted to pivot on support 298 when valve rod 294 is shifted. An actuator plate 300 (shown in FIG. 20, but not in FIG. 15) is coupled to the end of crank arm 296 opposite valve rod 294. In operation, when cam disk 274 is rotated, valve rod 294 is raised and lowered according to the curvature of valve cam 290. As valve rod 294 is raised and lowered, actuator plate 300 is raised and lowered into and out of contact with valve stems 248, thereby opening and closing exhaust valves 250.

FIGS. 21–26 show a Stirling engine 400 in accordance with an embodiment of the present invention. As used herein the term "Stirling engine" shall mean an engine which employs the heating (i.e., expansion) and cooling (i.e., contraction) of a working fluid transferred back and forth between at least two working chambers to drive a piston positioned adjacent at least one of the working chambers. Stirling engine 400 preferably has a barrel-type configuration and employs a plurality of double-acting pistons 402. Further, pistons 402 are preferably fluidically coupled to one another in a parallel configuration. As used herein, the term "parallel configuration" shall mean that two cylinders of the same Stirling engine are fluidically connected so that both ends of the cylinders remain at a similar upper temperature and both ends the other cylinder remain at a similar lower temperature.

Referring now to FIG. 21, Stirling engine 400 generally comprises an outer engine case 404, an inner engine case 406, outer transverse bulkheads 408, middle transverse bulkheads 410, and inner transverse bulkheads 412. Outer engine case 404, inner engine case 406, outer transverse bulkheads 408, and middle transverse bulkheads 410 at least partially define a pair of outer chambers 414. Outer engine case 404, inner engine case 406, and middle transverse bulkheads 410 cooperate to define an inner chamber 416 located between middle transverse bulkheads 410. Thus, middle transverse bulkheads 410 separate the interior of Stirling engine 400 into outer and inner chambers 414, 416. Outer and inner chambers 414, 416 are preferably fluidically isolated from one another.

Figure 22:
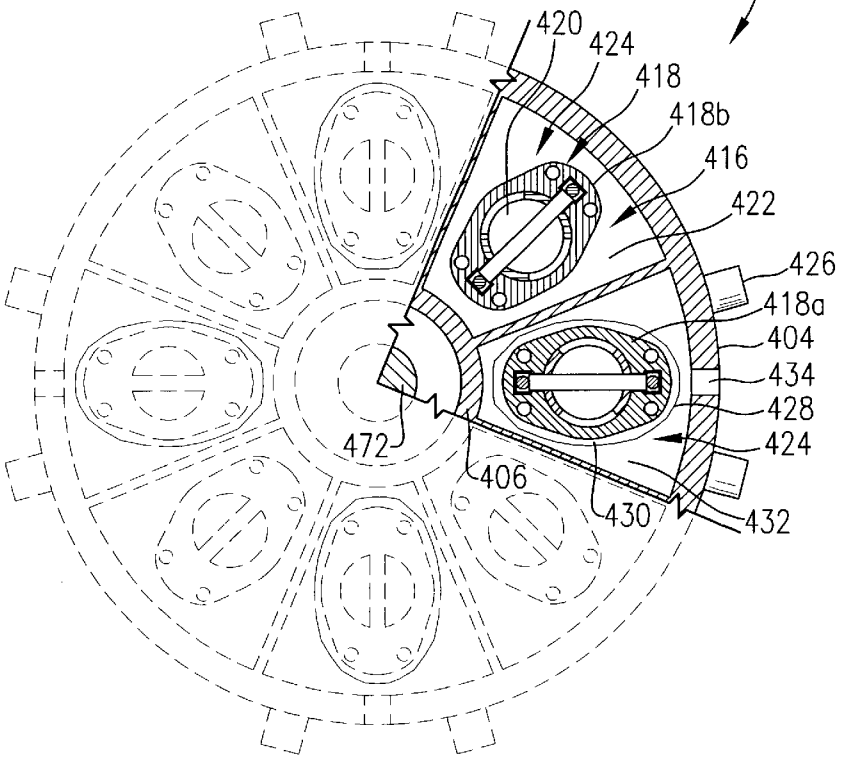
FIG. 22 is a sectional view of the Stirling engine taken along line 22—22 in FIG. 21, showing the manner in which combustion air enters the engine.

As shown in FIGS. 21 and 22, a plurality of cylinder assemblies 418 are disposed in inner chamber 416 and coupled between middle transverse bulkheads 410. Cylinder assembly 418 separates inner chamber 416 into an internal cylinder chamber 420 (disposed generally within cylinder assembly 418) and an external chamber 422 (disposed generally outside cylinder assembly 418). Cylinder assembly 418 is operable to fluidically isolate internal cylinder chamber 420 from external cylinder chamber 422.

Referring now to FIG. 21, external chamber 422 is divided into head transfer chambers 424 and an exhaust gas plenum 426 by inner transverse bulkheads 412. Exhaust gas plenum 426 is located generally between inner transverse bulkheads 412 and is fluidically isolated from head transfer chambers 424. As shown in FIG. 22, certain of cylinder assemblies 418 (i.e., expansion cylinder 418*a*) are designed to be maintained at a higher temperature while other cylinder assemblies 418 (i.e., compression cylinders 418*b*) are designed to be maintained at lower temperatures. Compression cylinder 418*b* is preferably surrounded by a coolant flowing through heat transfer chambers 424 and operable to cool compression cylinder 418*b*. As shown in FIGS. 21 and 22, expansion cylinder 418*a* has a heat shroud 428 located in heat transfer chamber 424 and at least partially surrounding expansion cylinder 418*a*. Heat shroud 428 divides each heat transfer chamber 424 into an exhaust chamber 430 and a combustion air chamber 432. Combustion air chamber 432 is fluidically coupled to an air intake port 434 and a combustion chamber 436 (shown in FIG. 21). Exhaust chamber is fluidically coupled to combustion chamber 436 and exhaust gas plenum 426.

In operation, combustion air enters engine 400 through air intake port 434 (shown in FIG. 21) and flows to combustion chamber 436 via combustion air chamber 432. The combustion air is mixed with fuel and ignited in combination chamber 436 to provide heat. The exhaust gas generated by the combustion exits combustion chamber 436 through exhaust chamber 430 and exits engine 400 via exhaust gas plenum 426. Thus, the exhaust gas transported through exhaust chamber 430 and the combustion air transported through combustion air chamber 432 flow in opposite directions on either side of heat shroud 428. This type of flow allows for heat in the outflowing exhaust gas to be transferred to the inflowing combustion air in a reverse-flow heat exchange configuration. Such a reverse-flow heat exchange between the exhaust gas and the combustion air increases the efficiency of engine 400.

Stirling engine 400 is an external combustion engine, which means that the combustion occurs remotely from piston 402, and, thus, the combustion does not directly cause movement of piston 402. Rather, the combustion which takes place in Stirling engine 400 is performed solely for the purpose of providing heat to expand the working fluid.

Referring to FIG. 23, a compressible working fluid, such as hydrogen or helium, is transferred back and forth between adjacent expansion cylinders 418*a* and compression cylinders 418*b* via a regenerator 438. Regenerator 438 can be any regenerator known in the art to be useful for extracting, storing, and transferring heat to and from a working fluid flowing therethrough as part of a Stirling cycle.

Referring to FIG. 24 in combination with FIG. 21, the manner in which heat is transferred to and from the working fluid is an important aspect of one embodiment of the present invention. Stirling engine 400 employs a heat exchanger 440 which is integral with each cylinder assembly 418. Cylinder assembly 418 includes at least one common wall 442 which defines a portion of a heat exchange chamber 444 as well as portion of a working fluid chamber 446. Heat exchanger 440 is disposed in heat exchange chamber 444 and is coupled to common wall 442. If heat exchanger chamber 444 is part of an expansion cylinder 418*a* then heat exchange chamber 444 is a combustion chamber 436 where a fuel/air mixture is burned to generate heat. If heat exchange chamber 444 is part of a compression cylinder 418*b*, then heat exchange chamber 444 will be filled with a coolant flowing therethrough. In either case, heat exchanger 440 includes a regenerator duct 448 for transferring the working fluid between regenerator 438 and heat exchanger 440, a cylinder duct 450 for transferring the working fluid between working fluid chamber 446 and heat exchanger 440, and a plurality of working fluid ports 452 (best shown in FIG. 25) fluidically coupling regenerator duct 448 and cylinder duct 450. As the working fluid flows into and out of working fluid chamber 446 via heat exchanger 440, heat is exchanged between the working fluid and the heat exchange chamber 444.

A significant advantage of having heat exchanger 440 integral with cylinder assembly 418 is that not only is heat exchanged with the working fluid by the heat exchanger 440, but heat is also physically conducted, via common wall 442, between heat exchange chamber 444 and internal wall 454 which at least partly defines working fluid chamber 446. Thus, adiabatic cooling of the working fluid in expansion cylinder 418*a* is reduced by physically heating internal wall 454 and adiabatic heating of the working fluid in compression cylinder 418*b* is reduced by physically cooling internal wall 454. This physical heat conduction between that exchange chamber 444 and internal wall 454 allows engine 400 to operate more efficiently than Stirling engines having heat exchanger which are spaced from the cylinder assembly.

Referring again to FIG. 23, FIG. 23 includes three sections (a, b, and c), each illustrating a different portion of a cylinder assembly 418 and heat exchanger 440. Section "a" of FIG. 23 shows that combustion air enters a bottom portion of heat exchange chamber 444 of expansion cylinder 418*a* at a location generally between common wall 442 and heat exchanger 440. The combustion air can be mixed with a combustible fuel prior to entering heat exchange chamber 444 or, alternatively, the combustion air can be mixed with a combustible fuel which is simultaneously injected into heat exchange chamber 444. In either case, the fuel/air mixture is ignited in heat exchange chamber 444 of expansion cylinder 418*a* to produce heat. Arrows 455 illustrate the direction of flow of the combustible/combusted fuel/air mixture along the bottom of heat exchanger 440. Arrows 455 further illustrate that the combusted/combustible fuel/air mixture flows towards a blister 457 which carries the mixture around an outer edge of heat exchanger 440 and upwards towards the top of heat exchanger 440. Section "c" of FIG. 23 shows the combusted/combustible fuel/air mixtures enters an upper portion of heat exchange chamber 444 through blisters 457 and then travels over the top of heat exchanger 400 as shown by arrows 459. The exhaust gas from the combusted fuel/air mixture then exits heat exchange chamber 444 via ports 463 and enters exhaust chamber 430 which is defined by heat shroud 428.

Referring again to FIG. 21, a further advantage of one embodiment of the present invention is a cylinder/piston rod configuration which allows for lubrication of piston 402 without contaminating the working fluid in working fluid chamber 446. Internal cylinder chamber 420 generally receives piston 402 and at least a portion of a piston rod assembly 456. Piston 420 sealingly contacts internal wall 454 and divides internal cylinder chamber 420 into working fluid chamber 446 and a piston rod chamber 460. Because piston rod chamber 460 is substantially fluidically isolated from working fluid chamber 446, outer chamber 414, and external chamber 422, piston rod chamber 460 can contain a separate lubricating fluid which is operable to lubricate and further seal the interface between piston 402 and internal wall 454. Because a small amount of the lubricating fluid will inevitably leak into working fluid chamber 446 and become entrained in the working fluid, it is preferred that the lubricating fluid be composed of a substance which can easily be separated from the working fluid without causing fouling of regenerator 438 as the working fluid flows through regenerator 438. Preferably, the lubricating fluid contained in piston rod chamber 460 is a non-hydrocarbon-based lubricant, such as water.

The use of a non-hydrocarbon fluid, such as steam and/or water, as a lubricant for Stirling engine requires that the amount of lubricant passing into working fluid chamber 446 is small. This is accomplished firstly by having pistons 402 subjected only to axial forces. The side forces acting on pistons 402 in current internal combustion engines are not present in the inventive engine. As a result, the piston rings can tightly conform to internal wall 454 thereby reducing loss of lubricant to the working fluid.

In the inventive configuration, the working fluid will contain only a small amount of entrained steam. The steam will condense in the coldest part of the engine (most likely heat exchanger 440 of compression cylinder 418*b*) where it can be removed from the working fluid as a liquid. One preferred mechanism for removing condensed steam involves a syringe-like device that acts as a miniature positive displacement pump.

Steam entrained in the working fluid could possibly condense in regenerator 438. The effect of condensation on regenerator 438 efficiency is actually unknown, but it is surmised to be negative for the purpose of this discussion. Compared to hydrocarbon-based lubricants, however, water is a much better conductor of heat. Thus, the effect of water on regenerator efficiency may be small.

Due to surface tension, the water tends to bead up into droplets making it easier for gravity to assist in the removal of liquid from regenerators 438. The working fluid temperature will be near its maximum as it enters regenerator 438 after leaving heat regenerator 440 of expansion cylinder 418*a,* and will be near its minimum as it exits regenerator 438 and flows towards compression cylinder 418*b*. Regenerator 438 may be composed of innumerable combinations of materials and structures known in the art. A typical regenerator comprises a series of screens formed from very thin wires. These screens are stacked together, sintered to form a rigid system, then machined on a lathe to fit tightly inside a metal cylinder. The regenerator 438 preferably includes primarily a very fine, hydrophobic regenerator material and secondarily a small section of coarse, hydrophilic regenerator material located near the cold end of regenerator 438. The hydrophilic material is preferably composed of relatively thick, parallel wires that guide and direct condensate toward the liquid removal system. The hydrophilic material can be positioned within regenerator 438 so that the condensate will form first on this material. Condensate that forms on this material will not reduce the efficiency of the hydrophobic material present on either side of this section, and only a very small amount of dead space is formed.

Stirling engine 400 can include a lubricant recycle system which comprises an injector for providing the lubricant to piston rod chamber 460 via an injection port 461 in cylinder assembly 418 and a separator (such as the system described above) for removing the lubricant entrained in the working fluid. The separated lubricant can then be reinjected into piston rod chamber 460 via injection port 461.

The unique H-shaped of piston rod assembly 456 allows piston 402 to drive a pair of bearing assemblies 462 (located at opposite ends of piston 402 and along the line of action of piston 402) without having the piston rod assembly 456 extend through working fluid chamber 446. Each piston rod assembly 456 includes a pair of legs 464 which extend generally parallel to one another and generally parallel to the line of action of piston 402 on opposite sides of piston 402 and working fluid chambers 446. Legs 464 are coupled to one another and piston 402 by a cross member 466 which extends through piston 402. A center portion of each leg 464 is located in piston rod chamber 460, with the end portions of each leg 464 extending through openings 468 in middle transverse bulkheads 410. The lubricating fluid disposed in piston rod chamber 460 is operable to lubricate and further seal the interface between leg 464 and sealing member 470.

As described above, the reciprocal motion of pistons 402 caused by the expansion and contraction of the working fluid in working fluid chambers 446 causes piston rod assembly 460 and bearing assemblies 462 to reciprocate linearly. This linear reciprocation is converted into rotary motion of drive shaft 472 via cam disks 474 and roller bearings 476. As shown in FIG. 26, bearing assemblies 462 are restrained from twisting by inner and outer cross heads 478, 480, between which each bearing assembly 462 is slidably received.

FIGS. 27–30 show a double-barrel, double-acting, parallel, Stirling engine 500 in accordance with one embodiment of the present invention. As used herein, the term "double-barrel" shall mean an engine configuration wherein two groups of pistons 502 are symmetrically positioned about a central rotating drive shaft 504, with an inner piston group 506 being radially spaced from the axis of rotation of drive shaft 504 a first distance and an outer piston group 510 being spaced from the axis of a rotation of drive shaft 504 a second distance greater than the first distance.

Double-barrel Stirling engine 500 operates in substantially the same manner as the single-barrel Stirling engine described above, except that double-barrel Stirling engine 500 employs two pairs of cam disks (i.e., inner cam disks 512 and outer cam disks 514) and two groups of pistons 502 (i.e., inner piston group 506 and outer piston group 510). As shown in FIG. 28, each outer cylinder assembly 516 associated with outer piston group 510 is an expansion cylinder having a heat shroud 518. Each inner cylinder assembly 517 associated with inner piston group 506 is a compression cylinder. FIG. 29 shows that each outer cylinder assembly 516 is connected in parallel with a respective inner cylinder assembly 517 by a pair of regenerator ducts 520 and a regenerator 522.

Referring to FIGS. 27 and 30, the reciprocal movement of outer piston group 510 causes rotation of outer cam disks 514 via roller bearings 511 and outer curved cam surfaces 528. The reciprocal motion of inner piston group 506 causes rotation of inner cam disk 512 via roller bearings 515 and inner curved cam surfaces 526. Outer cam disk 514 is rigidly coupled to drive shaft 504, while inner cam disk 512 is coupled for rotation relative to outer cam disk 514 and drive shaft 504.

Pistons 502 of inner and outer piston groups 106, 110 reciprocate at substantially the same rate, however, the reciprocal motion of corresponding (i.e., radially aligned) inner and outer pistons is not synchronized. Therefore, corresponding inner and outer pistons do not reach top dead center at the same time. Rather, the reciprocal motion of one of the inner or outer pistons trails the reciprocal motion of the other of the inner or outer pistons in accordance with a piston phase angle. For example, if the outer piston is at top dead center when the inner piston is at bottom dead center the piston phase angle is 180 degrees. An optimum piston phase angle exists for all Stirling engines. By varying the piston phase angle of a Stirling engine above or below the optimum piston phase angle, the power of the Stirling engine can be readily controlled.

Referring to FIG. 27, power actuator 524 can cause inner cam disk 512 to be rotated relative to outer cam disk 514 to thereby vary the piston phase angle of Stirling engine 500. Power actuator 524 can be any rotatable power actuator known in the art. In a preferred embodiment, power actuator 524 is a hydraulic motor which can be powered by hydraulic fluid conducted to power actuator 524 via an axial bore 530 in a rod 532 and an oil line 534. An actuator shaft 536 can be equipped with gear teeth 538 that mesh with disk gear 540 on the outer perimeter of inner cam disk 512. Thus, rotation of actuator shaft 536 by actuator 524 causes rotation of inner cam disk 512 relative to outer cam disk 514. The shifting of inner cam disk 512 relative to outer cam disk 514 causes the relative curvature of outer and inner cam surfaces 526, 528 to be shifted so that the relative positions between outer and inner pistons 510, 506 (i.e., the piston phase angle) is varied. As the relative positions of outer and inner pistons 510, 506 are varied from the optimum relative positions, the power output of engine 500 decreases. Thus, equipping a double-barrel Stirling engine 500 with power actuator 524 allows the power output of engine 500 to be readily controlled.

FIGS. 31–33 show a crank-type Stirling engine 600 in accordance with an embodiment of the present invention. As used herein, the term "crank-type" shall mean an engine employing a rotating crank shaft 602 and connecting rods 604 coupled to crank shaft 602 (via a throw 660) at a location offset from the axis of rotation of crank shaft 602 to convert linear reciprocal motion into rotary motion.

Referring now to FIG. 31, engine 600 generally comprises an outer engine case 606, end transverse bulkheads 608, a middle transverse bulkhead 610, and end cap 612. Middle transverse bulkhead 610 separates engine 600 into a cylinder chamber 614 and an output chamber 616. A piston chamber bulkhead 618 divides piston chamber 614 into a hot-side chamber 620 and a cold-side chamber 622.

Referring to FIGS. 31 and 32, an expansion cylinder 624 is disposed in hot-side chamber 620 and a compression cylinder 626 is disposed in cold side chamber 622. Expansion and compression cylinders 624, 626 are fluidically coupled by a respective regenerator duct 628 and a regenerator 630. Each cylinder 624, 626 receives a reciprocating piston 632 which cooperates with a respective cylinder 624, 626 to define a working fluid chamber 634 of variable volume within each cylinder 624, 626. Each cylinder 624, 626 includes an integral heat exchanger 636. A heat shroud 638 is disposed in hot-side chamber 620. Heat shroud 638 separates hot-side chamber into an exhaust gas chamber 640 and a combustion air chamber 642. An expansion duct 623 connects adjacent expansion cylinders 624 and a compression duct 625 connects adjacent compression cylinders 626.

Referring again to FIG. 31, piston 632 extends through an opening 644 in middle transverse bulkhead 610 connects to connecting rod 604. Connecting rod 604 is coupled to crank shaft 602 at a location offset from the axis of rotation of crank shaft 602. An oil pan 646 is positioned generally below opening 644. A piston rod seal 648 is positioned in opening 644 as well as an opening in oil pan 648. Piston 632 extends through and is slidably received in seal 648. Cross heads 650 slidably receive pistons 632 and prevent lateral movement of piston 632 in output chamber 616.

Referring to FIGS. 31 and 33, crank gears 652 and crank shafts 602 mate with respective output gears 654 of an output shaft 656. In operation, when piston 632 reciprocates, connecting rods 604 rotate crank shafts 602 via throw 660. Crank shafts 602 cooperate to rotate output shaft 656 via gears 652, 654. Crossheads 650, connecting rods 604, and pistons 632 are not illustrated in FIG. 33 in order to provide a better view of the relationship between crank gears 652 and output gears 654.

Referring to FIG. 31, crankshaft 602 is mounted on a plate 603 that is slidable with respect to outer engine case 606 and output shaft 656. Crankshaft 602, connecting rod 604, and piston 632 can be shifted to the right and left (as illustrated in FIG. 31), thereby disengaging and engaging crankshaft 602 with output shaft 656 at various positions to thereby alter the piston phase angle and power output.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the two stroke diesel engine embodiment of the present invention can be easily converted to a steam engine by methods known in the art. In addition, the intake ports (now steam exhaust ports) from the two-stroke diesel engine and a flat-plate water heater can be added to the Stirling engine embodiment, and the fuel injector (now hot water injector) can be added to inject heated water into the heat exchanges (now flash boilers) creating a steam engine having many desirable attributes including increased safety and reduced mechanical complexity due to the elimination of intake valves. Thus, the present invention is intended to include steam engines.

The invention hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A motion converting apparatus comprising:

an elongated shaft adapted for rotation on a shaft axis;

a pair of spaced-apart cam disks each coupled to the shaft for rotation therewith and each presenting an inwardly facing curved cam surface;

a reciprocating piston positioned generally between the inwardly facing cam surfaces and adapted for linear reciprocal motion in a direction at least substantially parallel to the shaft axis; and at least a pair of cam engagement bearings coupled to the piston for reciprocal motion therewith, each of said bearings rollingly contacting a respective cam surface, said piston positioned generally between the bearings.

2. An apparatus as claimed in claim 1; and a piston rod assembly for coupling the piston to the bearings, said piston rod assembly comprising at least one unitary member which is coupled to the piston and both of the bearings.

3. An apparatus according to claim 2, said piston rod assembly having a generally H-shaped configuration including a pair of side-members and a cross-member extending between the side members, said cross-member extending at least partly through the piston and coupling the piston rod assembly to the piston.

4. An apparatus according to claim 3; and a pair of bearing housings each adapted to support a respective one of said bearings for rotational motion relative thereto, said bearing housings coupled to and extending between the side-members of the piston rod assembly at generally opposite ends of the piston rod assembly.

5. An apparatus according to claim 1, said piston being a double-ended piston having a first end at least partly defining a first working chamber and a second end at least partly defining a second working chamber, said first and second working chambers being spaced from one another.

6. An apparatus according to claim 5, said cam disks each presenting a generally circular outer perimeter, said outer perimeters radially spaced from the shaft axis, said outer perimeters cooperating to at least partly define a generally cylindrical working space, said working space extending between the cam surfaces and positioned within the outer perimeters.

7. An apparatus according to claim 6, said piston disposed in the working space.

8. An apparatus according to claim 6, said first and second working chambers at least partially disposed in the working space.

9. An apparatus according to claim 6; and a plurality of additional reciprocating pistons, said pistons being generally symmetrically spaced around the shaft axis.

10. An apparatus according to claim 9, said pistons disposed in the working space.

11. An engine comprising:

an elongated drive shaft adapted for rotation on a shaft axis;

a pair of spaced-apart cam disks each coupled to the shaft for rotation therewith and each presenting a curved cam surface, said curved cam surfaces facing generally inwardly towards one another;

a plurality of reciprocating pistons positioned between the cam surfaces and adapted for linear reciprocal motion in a direction at least substantially parallel to the shaft axis, said pistons being spaced generally symmetrically around the shaft axis;

a pair of bearing assemblies associated with each piston, each bearing assembly comprising a housing and a roller bearing supported for rotation relative to the housing, said roller bearing of each bearing assembly contacting a respective one of the cam surfaces, each of said pistons positioned generally between the pair of bearing assemblies associated with that piston; and a plurality of piston rod assemblies each coupling one of the pistons to the pair of bearing assemblies associated with that piston.

12. An engine according to claim 11, said cam disks each presenting an outer perimeter radially spaced from the shaft axis, each of said pistons spaced from the shaft axis a radial distance which is less than the maximum radial distance between the outer perimeter of the cam disks and the shaft axis.

13. An engine according to claim 11, each of said pistons having a double-ended configuration including a first end at least partly defining a first working chamber and a second end at least partly defining a second working chamber, said first and second working chambers being spaced from one another.

14. An engine according to claim 13, said engine being an internal combustion engine wherein combustion takes place in the first and second working chambers.

15. An engine according to claim 13, said engine being a Stirling engine wherein a working fluid is expanded or contracted in the first and second working chambers.

16. An engine comprising:

a housing at least partly defining an inner chamber;

a cylinder assembly disposed in the inner chamber and at least partly defining an internal cylinder chamber disposed generally within the cylinder assembly and an external chamber disposed generally outside the cylinder assembly, said internal cylinder chamber and said external chamber at least substantially fluidly isolated from one another, said cylinder assembly presenting an internal cylinder wall which at least partly defines the internal cylinder chamber;

a piston shiftably disposed in the internal cylinder chamber and presenting a sealing surface at least substantially sealingly contacting the internal cylinder wall, said piston separating the internal cylinder chamber into a working chamber and a piston rod chamber, said working chamber and said piston rod chamber at least substantially fluidly isolated from one another, said cylinder assembly defining a fluid inlet for providing a first lubricating fluid to the piston rod chamber, said first lubricating fluid providing lubrication of the sealing surface, said first lubricating fluid comprising water;

a piston rod at least partly disposed in the piston rod chamber and coupled to the piston for movement therewith;

a bulkhead coupled to the housing and separating the housing into at least one outer chamber and the inner chamber, said outer and inner chambers at least substantially fluidly isolated from one another;

said cylinder assembly coupled to the bulkhead, said bulkhead defining a rod-receiving opening, said piston rod slidably received in the rod-receiving opening and extending into the outer chamber; and a rod seal disposed at least partly in the rod-receiving opening and operable to at least substantially inhibit the passage of the first lubricating fluid into the outer chamber through the rod-receiving opening.

17. An engine according to claim 16; and a rotatable cam disk disposed in the outer chamber and presenting a curved cam surface, said curved cam surface facing generally towards the piston.

18. An engine according to claim 17; and a bearing assembly disposed in the outer chamber, coupled to the piston rod, and rollingly contacting the cam surface, said bearing assembly causing rotation of the cam disk when the piston is shifted relative to the cylinder assembly.

19. An engine according to claim 18; and a second lubricating fluid disposed in the outer chamber and operable to facilitate rolling of the bearing assembly on the cam surface.

20. An engine according to claim 19; and a drive shaft extending through the housing and rotatable on a shaft axis, said drive shaft coupled to the cam disk rotation therewith, said shaft axis oriented at least substantially parallel to the direction of shifting of the piston relative to the cylinder assembly.

21. An engine according to claim 20, said first lubricating fluid comprising water, said second lubricating fluid comprising oil.

22. An engine according to claim 21, said sealing member comprising a metallic piston ring.

23. An engine according to claim 22, and a heat transfer fluid flowing through said external chamber.

24. A cylinder assembly for a Stirling engine, said Stirling engine utilizing thermal energy transferred between a working fluid and a heat transfer fluid to generate mechanical energy via a reciprocating piston, said cylinder assembly comprising:

a piston chamber wall at least partially defining an internal cylinder chamber, said internal cylinder chamber adapted to shiftably receive the reciprocating piston, said piston chamber wall adapted to cooperate with the piston to at least partly define a working fluid chamber of variable volume within the cylinder assembly;

a heat transfer chamber fluidically isolated from the working fluid chamber;

a heat exchanger at least partly disposed in the heat transfer chamber and defining a working fluid passageway fluidically communicating with the working fluid chamber, said heat exchanger is adapted to facilitate the transfer of heat between the heat transfer fluid in the heat transfer chamber and the working fluid flowing through the working fluid passageway; and a thermally conductive wall defining at least a portion of the heat transfer chamber and physically coupled to the piston chamber wall, said thermally conductive wall operable to conduct heat between the heat transfer chamber and the piston chamber wall.

25. A cylinder assembly according to claim 31, said heat exchanger coupled to the thermally conductive wall.

26. A cylinder assembly according to claim 32, said thermally conductive wall including a port for fluidically coupling the working fluid passageway to the working fluid chamber.

27. A cylinder assembly according to claim 31, said heat exchanger defining a plurality of working fluid passageways for conducting the working fluid through the heat exchanger.

28. A cylinder assembly according to claim 34, said working fluid passageways fluidically isolated from the heat transfer chamber.

29. A cylinder assembly according to claim 31, said Stirling engine having a parallel configuration.

30. A cylinder assembly according to claim 31, said Stirling engine having a barrel-type configuration.

31. A cylinder assembly according to claim 31, said Stirling engine having a crank-type configuration.

32. A Stirling engine having an expansion piston positioned for linear reciprocal movement in an expansion cylinder and a compression piston positioned for linear reciprocal movement in a compression cylinder, said pistons reciprocating at substantially the rate, wherein the reciprocal motion of one said pistons trails the reciprocal motion of the other of said pistons in accordance with a piston phase angle, said Stirling engine comprising:

a first member adapted to be rotated by the expansion piston;

a second member adapted to be rotated by the compression piston;

an output member cooperatively rotated by the first and second members and providing a power output; and means for selectively shifting one of the first or second members relative to the other members so that the piston phase angle is charged, thereby varying the power output of the Stirling engine, said Stirling engine having a barrel-type configuration, said first member comprising an outer cam disk presenting a curve outer cam surface, said second member comprising an inner cam disk presenting a curved inner cam surface, one of said cam disks being rigidly coupled to the output member for rotation therewith, the other of the cam disks being rotatable relative to the output member by the means for selectively shifting.

33. A Stirling engine according to claim 44, said means for shifting comprising a power actuator operable to rotate said other of the cam disks relative to said one of the cam disks and the output member.

34. A Stirling engine according to claim 45; and an outer bearing assembly rollingly contacting the curved outer cam surface and adapted to be coupled to one of the pistons for linear reciprocal movement therewith; and an inner bearing rollingly contacting the curved inner cam surface and adapted to be coupled to the other of the pistons for linear reciprocal movement therewith.

* * * * *